US010794404B2

(12) United States Patent
Tanaka

(10) Patent No.: US 10,794,404 B2
(45) Date of Patent: Oct. 6, 2020

(54) CYLINDER DRIVING DEVICE

(71) Applicant: KYB Corporation, Tokyo (JP)

(72) Inventor: Daisuke Tanaka, Gifu (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 16/312,323

(22) PCT Filed: Jun. 26, 2017

(86) PCT No.: PCT/JP2017/023440
§ 371 (c)(1),
(2) Date: Dec. 21, 2018

(87) PCT Pub. No.: WO2018/003753
PCT Pub. Date: Jan. 4, 2018

(65) Prior Publication Data

US 2019/0234431 A1 Aug. 1, 2019

(30) Foreign Application Priority Data

Jun. 30, 2016 (JP) ..... 2016-130544

(51) Int. Cl.
*F15B 11/044* (2006.01)
*F15B 11/08* (2006.01)
(Continued)

(52) U.S. Cl.
CPC ..... *F15B 11/044* (2013.01); *F15B 11/0426* (2013.01); *F15B 11/08* (2013.01); *F15B 7/006* (2013.01); *F15B 15/04* (2013.01); *F15B 15/18* (2013.01); *F15B 2211/20515* (2013.01); *F15B 2211/20561* (2013.01); *F15B 2211/27* (2013.01); *F15B 2211/3051* (2013.01); *F15B 2211/40507* (2013.01); *F15B 2211/40592* (2013.01); *F15B 2211/411* (2013.01); *F15B 2211/4159* (2013.01); *F15B 2211/41572* (2013.01); *F15B 2211/428* (2013.01);
(Continued)

(58) Field of Classification Search
CPC .... F14B 11/044; F14B 11/0426; F14B 7/006; F14B 15/04; F14B 15/18; F15B 11/044; F15B 11/0426; F15B 7/006; F15B 15/04; F15B 15/18
See application file for complete search history.

(56) References Cited

U.S. PATENT DOCUMENTS

2006/0242957 A1 11/2006 Sakai et al.
2016/0091004 A1* 3/2016 Gomm ..... F15B 21/10 60/327

FOREIGN PATENT DOCUMENTS

JP S53-152225 U 11/1978
JP 2006-250311 A 9/2006
JP 2008-309212 A 12/2008

* cited by examiner

*Primary Examiner* — Thomas E Lazo
*Assistant Examiner* — Daniel S Collins
(74) *Attorney, Agent, or Firm* — Rabin & Berdo, P.C.

(57) ABSTRACT

A cylinder driving device includes: an electric motor; a pump; a main passage and a main passage; a hydraulic cylinder; an operation check valve and an operation check valve; and a restriction valve and a restriction valve configured to restrict a flow of the working oil directed to the operation check valve and an operation check valve, wherein an opening area of the restriction valve and the restriction valve is reduced in response to an increase in a flow rate of the working oil discharged from the hydraulic cylinder to the main passage and a main passage.

7 Claims, 11 Drawing Sheets

(51) Int. Cl.

| | |
|---|---|
| ***F15B 11/042*** | (2006.01) |
| *F15B 7/00* | (2006.01) |
| *F15B 15/04* | (2006.01) |
| *F15B 15/18* | (2006.01) |

(52) U.S. Cl.
CPC ..... *F15B 2211/46* (2013.01); *F15B 2211/47* (2013.01); *F15B 2211/50518* (2013.01); *F15B 2211/761* (2013.01); *F15B 2211/785* (2013.01); *F15B 2211/8613* (2013.01); *F15B 2211/895* (2013.01)

CYLINDER DRIVING DEVICE

TECHNICAL FIELD

The present invention relates to a cylinder driving device.

BACKGROUND ART

JP2006-250311A discloses a hydraulic driving unit that includes a hydraulic pump that is driven by an electric motor, a hydraulic cylinder that is operated with working oil from the hydraulic pump, and an operation check valve that controls a flow of the working oil between the hydraulic pump and the hydraulic cylinder.

SUMMARY OF INVENTION

A cylinder driving device including the operation check valve or a control valve having the same function as the operation check valve may experience a hunting phenomenon in which the hydraulic cylinder is repeatedly operated and stopped even during the operation of the pump. The hunting phenomenon is caused when an the external force due to a load is exerted to the hydraulic cylinder, and the hydraulic cylinder is forced to function as a pump and sucks the working oil in a passage.

In the hydraulic driving unit disclosed in JP2006-250311A, in order to prevent the occurrence of the hunting phenomenon, a slow return valve is provided in a pipe channel between the hydraulic cylinder and the operation check valve. Because the flow of the working oil that is discharged from the hydraulic cylinder to the pipe channel is restricted by the slow return valve, the working oil in the passage is not sucked to the hydraulic cylinder, and the hunting phenomenon is prevented.

However, with the slow return valve disclosed in JP2006-250311A, an opening area of the restrictor is constant. Even in a condition in which the hunting phenomenon does not occur, the flow of the working oil flowing out from the hydraulic cylinder is restricted in a similar manner as in the case in which the hunting phenomenon occurs. Therefore, a large amount of energy is always required to operate the hydraulic cylinder, and the electric power consumption of the electric motor is increased.

An object of the present invention is to reduce an electric power consumption of an electric motor and to prevent the occurrence of a hunting phenomenon.

According to one aspect of the present invention, a cylinder driving device includes: an electric motor; a pump configured to be driven by the electric motor and discharge working fluid; a first passage and a second passage respectively connected to the pump, the first passage and the second passage being configured to selectively guide the working fluid from the pump; a fluid pressure cylinder connected to the first passage and the second passage, the fluid pressure cylinder being configured to be operated by the working fluid supplied from one of the first passage and the second passage, the fluid pressure cylinder being configured to discharge the working fluid to the other of the first passage and the second passage when operated; a control valve provided in the second passage, the control valve being configured to allow a flow of the working fluid directed from the fluid pressure cylinder to the pump in response to an increase in a pressure in the first passage while allowing a flow of the working fluid directed from the pump to the fluid pressure cylinder; and a restriction valve provided between the fluid pressure cylinder and the control valve in the second passage, the restriction valve being configured to restrict a flow of the working fluid directed from the fluid pressure cylinder to the control valve. An opening area of the restriction valve is reduced in response to an increase in a flow rate of the working fluid discharged from the fluid pressure cylinder to the second passage.

DESCRIPTION OF EMBODIMENT

A cylinder driving device 100 according to an embodiment of the present invention will be described below with reference to the drawings.

Figure 1:
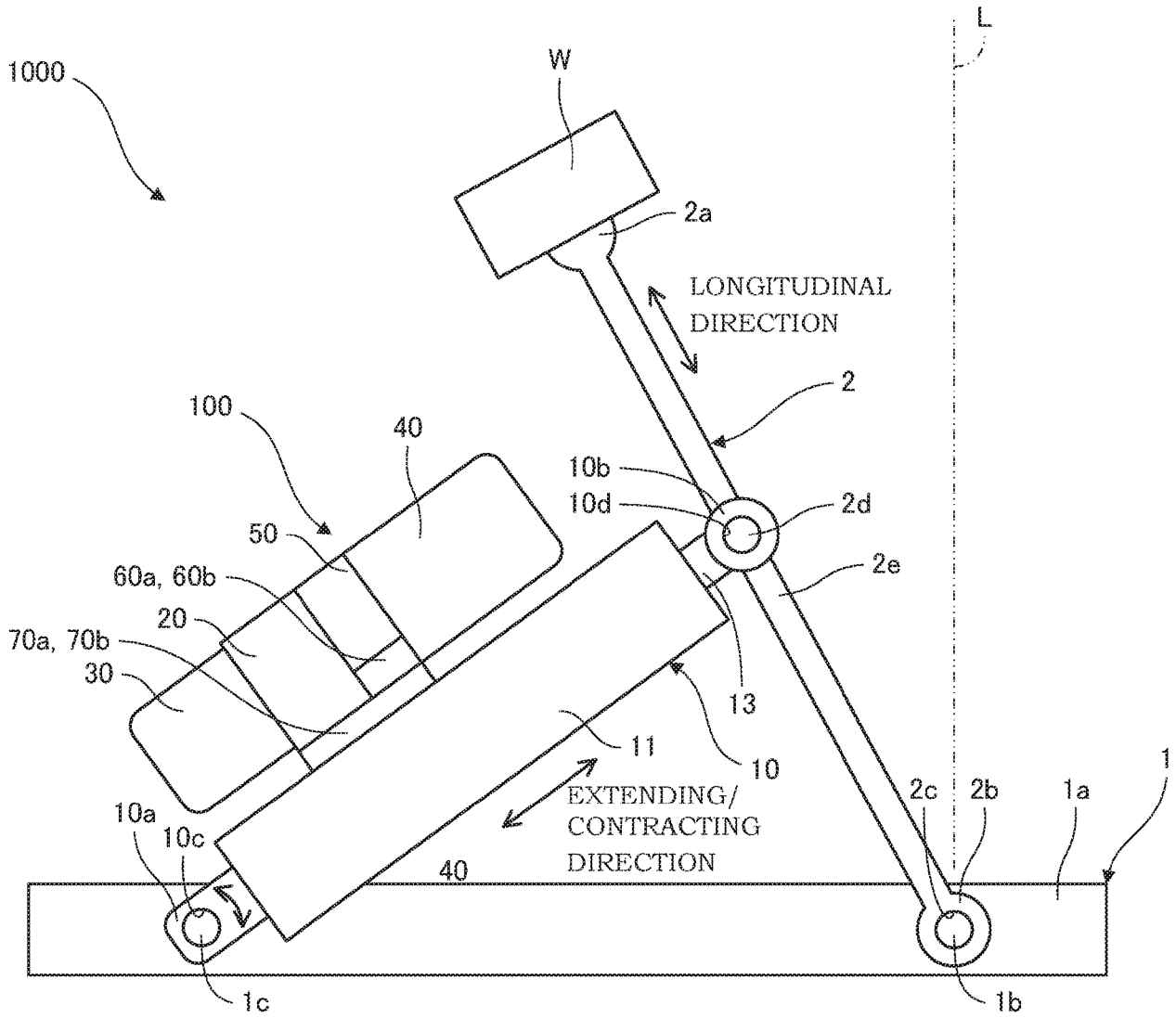
FIG. 1 is a schematic view of a rotating device provided with a cylinder driving device according to an embodiment of the present invention.

FIG. 1 is a schematic view of a rotating device 1000 provided with the cylinder driving device 100. The cylinder driving device 100 is provided with a hydraulic cylinder 10 that extends/contracts by a pressure of working oil. The rotating device 1000 rotates a target object W by the extension/contraction of the hydraulic cylinder 10.

As shown in FIG. 1, the rotating device 1000 is provided with a base member 1 and an arm member 2 linked to the base member 1. The arm member 2 is formed to have a rod shape. The target object W is attached to an end portion 2*a* of the arm member 2.

An end portion 2*b* of the arm member 2 is formed with a hole 2*c*. The hole 2*c* penetrates through the end portion 2*b* in the direction perpendicular to the longitudinal direction of the arm member 2. A pin 1*b* formed on the base member 1 is inserted into the hole 2*c*.

The pin 1*b* of the base member 1 projects out from a main body portion 1*a* of the base member 1 in the horizontal direction. The outer diameter of the pin 1*b* is equal to or less than the inner diameter of the hole 2*c* of the arm member 2, and the end portion 2*b* of the arm member 2 is rotatably supported by the pin 1*b*. As described above, the arm member 2 is linked to the base member 1 so as to be freely rotatable about the pin 1*b* (about the horizontal axis).

The hydraulic cylinder 10 is provided with a cylinder 11 and a piston rod 13 that extends out from the cylinder 11. The piston rod 13 is capable of advancing/retracting with respect to the cylinder 11. As the piston rod 13 retracts out from the cylinder 11, the hydraulic cylinder 10 is extended. As the piston rod 13 advances into the cylinder 11, the hydraulic cylinder 10 is contracted.

The cylinder 11 is provided with a linkage portion 10*a* by which the hydraulic cylinder 10 is linked to the base member 1. The linkage portion 10*a* is formed with a hole 10*c* that penetrates through the linkage portion 10*a* in the direction perpendicular to the extending direction of the hydraulic cylinder 10. A pin 1*c* formed on the base member 1 is inserted into the hole 10*c*.

The pin 1*c* of the base member 1 projects out from the main body portion 1*a* of the base member 1 in the same direction as the projecting direction of the pin 1*b*. The outer diameter of the pin 1*c* is equal to or less than the inner diameter of the hole 10*c* of the hydraulic cylinder 10, and the linkage portion 10*a* of the hydraulic cylinder 10 is rotatably supported by the pin 1*c*. As described above, the hydraulic cylinder 10 is linked to the base member 1 so as to be freely rotatable about the pin 1*c* (about the horizontal axis).

The piston rod 13 is provided with a linkage portion 10*b* by which the hydraulic cylinder 10 is linked to the arm member 2. The linkage portion 10*b* is formed with a hole 10*d* that penetrates the linkage portion 10*b* in the same direction as the penetrating direction of the hole 10*c* of the hydraulic cylinder 10. A pin 2*d* formed on the arm member 2 is inserted into the hole 10*d*.

The pin 2*d* of the arm member 2 is provided on a middle portion 2*e* that is formed between the end portions 2*a* and 2*b*. The projecting direction of the pin 2*d* corresponds to the projecting direction of the pin 1*b* and the pin 1*c* of the base member 1. The outer diameter of the pin 2*d* is equal to or less than the inner diameter of the hole 10*d* of the hydraulic cylinder 10, and the linkage portion 10*b* of the hydraulic cylinder 10 is rotatably supported by the pin 2*d*. As described above, the hydraulic cylinder 10 is linked to the arm member 2 so as to be freely rotatable about the pin 2*d* (about the horizontal axis).

A two-dot chain line in FIG. 1 shows an imaginary line L that extends in the vertical direction through the pin 1*b*. In FIG. 1, a state in which the hydraulic cylinder 10 is contracted to the utmost extents is shown. In this state, the centers of gravity of the target object W and the arm member 2 are positioned at positions higher than the pin 1*b* in the vertical direction and at positions on the pin 1*c* side of the imaginary line L. Gravity acting on the target object W and the arm member 2 acts as the load on the piston rod 13 in the direction in which the hydraulic cylinder 10 is contracted.

Figure 2:
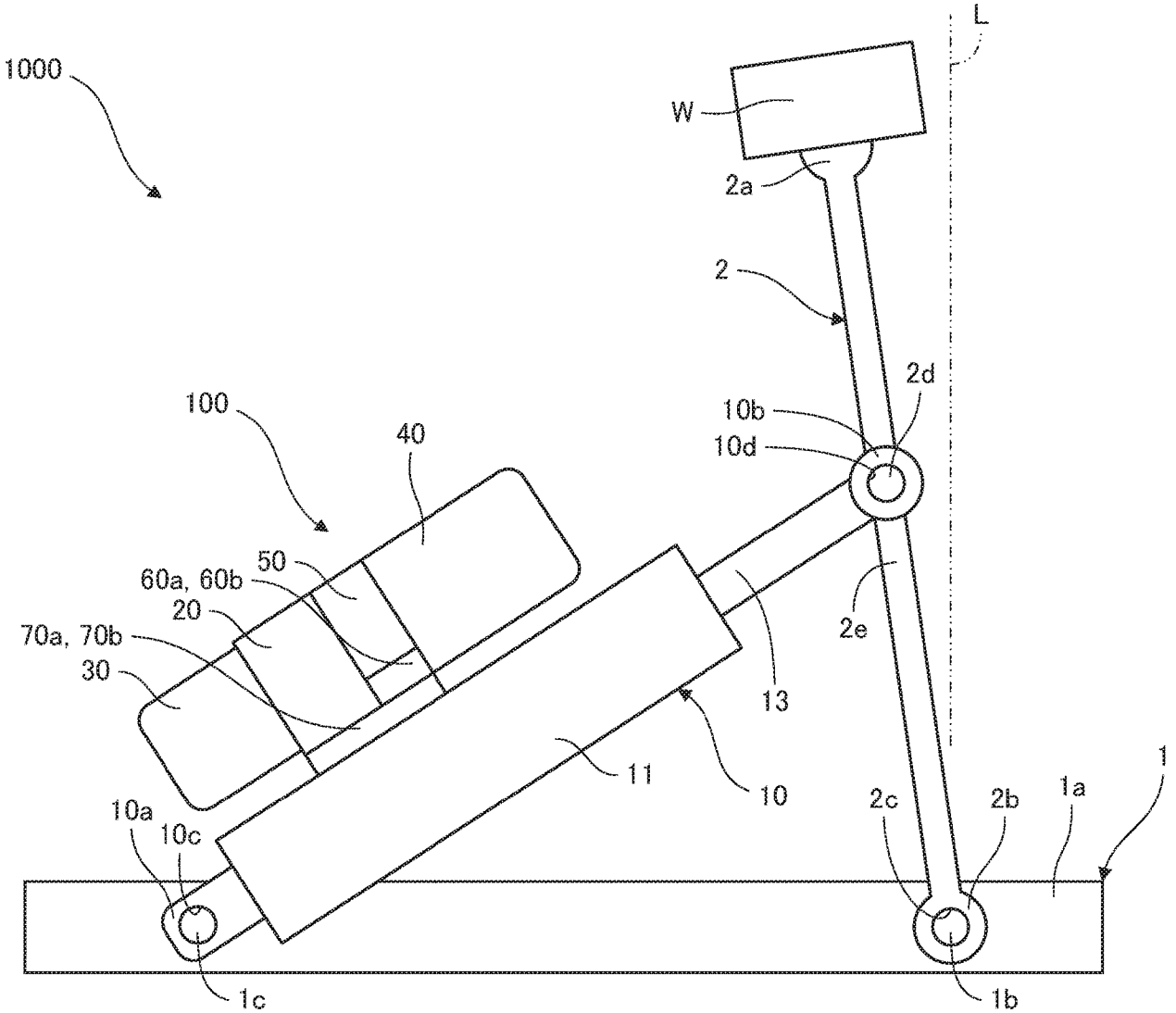
FIG. 2 shows a state in which a hydraulic cylinder shown in FIG. 1 is extended.

FIG. 2 shows a state in which the hydraulic cylinder 10 is extended from the state shown in FIG. 1. As the hydraulic cylinder 10 is extended, the arm member 2 is rotated about the pin 1*b* with respect to the base member 1. Along with the rotation of the arm member 2, the target object W is also rotated with respect to the base member 1.

As described above, the rotating device 1000 rotates the target object W by the extension/contraction of the hydraulic cylinder 10.

In the state shown in FIG. 2, similarly to the state shown in FIG. 1, the centers of gravity of the target object W and the arm member 2 are positioned at positions higher than the pin 1*b* in the vertical direction and at positions on the pin 1*c* side of the imaginary line L. Gravity acting on the target object W and the arm member 2 acts as the load on the piston rod 13 in the direction in which the hydraulic cylinder 10 is contracted.

Figure 3:
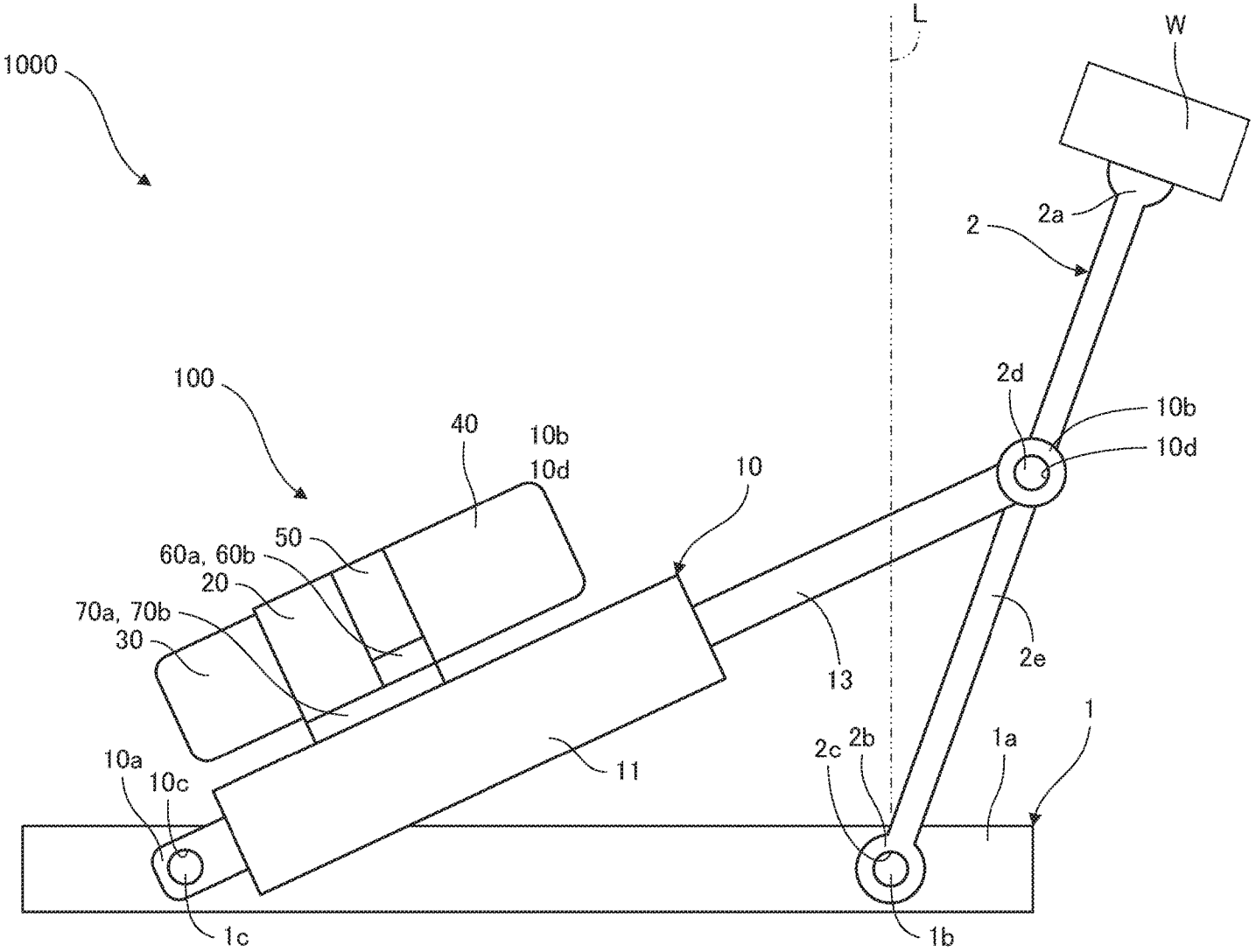
FIG. 3 shows a state in which the hydraulic cylinder shown in FIG. 2 is extended further.

FIG. 3 shows a state in which the hydraulic cylinder 10 is further extended from the state shown in FIG. 2. In the state shown in FIG. 3, the centers of gravity of the target object W and the arm member 2 are positioned at positions higher than the pin 1*b* in the vertical direction and at positions on the opposite side of the pin 1*c* with respect to the imaginary line L. Gravity acting on the target object W and the arm member 2 acts as the load on the piston rod 13 in the direction in which the hydraulic cylinder 10 is extended.

As described above, with the rotating device 1000, along with the operation of the hydraulic cylinder 10, the direction in which the load acts on the piston rod 13 of the hydraulic cylinder 10 is reversed.

Figure 4:
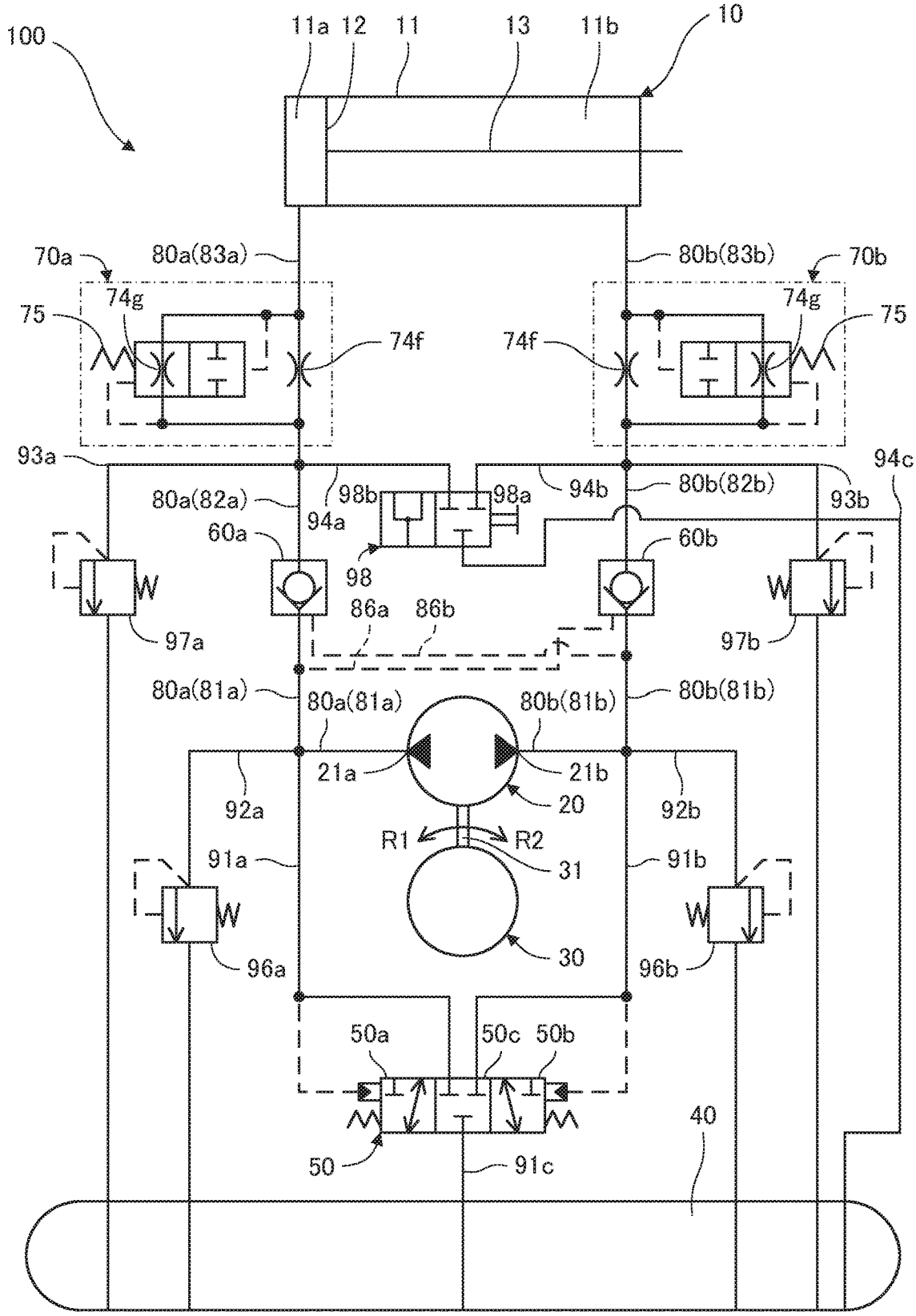
FIG. 4 is a circuit diagram of the cylinder driving device according to the embodiment of the present invention.

As shown in FIG. 4, the hydraulic cylinder 10 is further provided with a piston 12 that is slidably accommodated in the cylinder 11. The piston rod 13 is connected to the piston 12. The interior of the cylinder 11 is partitioned into a counter rod side chamber 11*a* and a rod side chamber 11*b* by the piston 12.

The counter rod side chamber 11*a* and the rod side chamber 11*b* are filled with the working oil. The piston 12 is moved with respect to the cylinder 11 by the working oil that is selectively supplied to the counter rod side chamber 11*a* and the rod side chamber 11*b*. As the piston 12 is moved, the piston rod 13 advances/retracts with respect to the cylinder 11, and the hydraulic cylinder 10 is extended/contracted.

More specifically, when the working oil is supplied to the counter rod side chamber 11*a*, the piston 12 is moved in the direction in which the size of the counter rod side chamber 11*a* is increased and the size of the rod side chamber 11*b* is reduced. As the piston 12 is moved, the piston rod 13 retracts out from the cylinder 11. As a result, the hydraulic cylinder 10 is extended. At this time, as the size of the rod side chamber 11*b* is reduced, the working oil in the rod side chamber 11*b* is discharged to the outside of the hydraulic cylinder 10.

When the working oil is supplied to the rod side chamber 11*b*, the piston 12 is moved in the direction in which the size of the rod side chamber 11*b* is increased and the size of the counter rod side chamber 11*a* is reduced. As the piston 12 is moved, the piston rod 13 advances into the cylinder 11. As a result, the hydraulic cylinder 10 is contracted. At this time, as the size of the counter rod side chamber 11*a* is reduced, the working oil in the counter rod side chamber 11*a* is discharged to the outside of the hydraulic cylinder 10.

The cylinder driving device 100 is provided with a pump 20 that supplies the working oil to the hydraulic cylinder 10 and an electric motor 30 that drives the pump 20. The electric motor 30 is electrically connected to a power source (not shown) and is operated by the electrical power supplied from the power source.

The pump 20 is connected to an output shaft 31 of the electric motor 30 and is driven by a rotational driving force from the electric motor 30. The pump 20 is formed with a first port 21*a* and a second port 21*b*, and the working oil is discharged from the first port 21*a* and the second port 21*b* selectively.

When the output shaft 31 of the electric motor 30 is rotated in a forward direction R1, the pump 20 sucks the working oil from the second port 21*b* and discharges the working oil from the first port 21*a*. When the output shaft 31 of the electric motor 30 is rotated in a reverse direction R2, the pump 20 sucks the working oil from the first port 21*a* and discharges the working oil from the second port 21*b*.

As described above, the discharge direction of the pump 20 is switched depending on the rotation direction of the electric motor 30. As the pump 20, for example, a gear pump can be used.

A main passage 80*a* is connected to the first port 21*a* of the pump 20, and a main passage 80*b* is connected to the second port 21*b* of the pump 20. The working oil is selectively guided from the pump 20 to the main passage 80*a* and the main passage 80*b*.

The main passage 80*a* is connected to the counter rod side chamber 11*a* of the hydraulic cylinder 10, and the main passage 80*b* is connected to the rod side chamber 11*b* of the hydraulic cylinder 10. The main passage 80*a* is provided with an operation check valve (control valve) 60*a* that controls the flow of the working oil, and the main passage 80*b* is provided with an operation check valve (control valve) 60*b* that controls the flow of the working oil. A restriction valve 70*a* is provided between the operation check valve 60*a* in the main passage 80*a* and the counter rod side chamber 11*a*. A restriction valve 70*b* is provided between the operation check valve 60*b* in the main passage 80*b* and the rod side chamber 11*b*.

In the following description, a portion between the first port 21*a* of the pump 20 and the operation check valve 60*a* in the main passage 80*a* is referred to as "a passage portion 81*a*". A portion between the second port 21*b* of the pump 20 and the operation check valve 60*b* in the main passage 80*b* is referred to as "a passage portion 81*b*". A portion between the operation check valve 60*a* and the restriction valve 70*a* in the main passage 80*a* is referred to as "a passage portion 82*a*", and a portion between the operation check valve 60*b* and the restriction valve 70*b* in the main passage 80*b* is referred to as "a passage portion 82*b*". A portion between the restriction valve 70*a* in the main passage 80*a* and the counter rod side chamber 11*a* is referred to as "a passage portion 83*a*", and a portion between the restriction valve 70*b* in the main passage 80*b* and the rod side chamber 11*b* is referred to as "a passage portion 83*b*".

The operation check valve 60*a* allows the flow of the working oil discharged from the first port 21*a* of the pump 20 and directed to the counter rod side chamber 11*a* of the hydraulic cylinder 10 through the main passage 80*a*. In addition, the operation check valve 60*a* has a back-pressure chamber (not shown). When the pressure in the back-pressure chamber reaches a valve opening pressure, the operation check valve 60*a* is opened to allow the flow of the working oil in the main passage 80*a*.

The back-pressure chamber of the operation check valve 60*a* is connected to the passage portion 81*b* of the main passage 80*b* via a pilot passage 86*b*. When the pressure in the passage portion 81*b* is increased, the pressure in the back-pressure chamber of the operation check valve 60*a* is increased, and the operation check valve 60*a* is opened. In other words, in response to the increase in the pressure in the passage portion 81*b*, the operation check valve 60*a* allows the flow of the working oil from the counter rod side chamber 11*a* of the hydraulic cylinder 10 to the first port 21*a* of the pump 20 through the main passage 80*a*.

Similarly, the operation check valve 60*b* allows the flow of the working oil discharged from the second port 21*b* of the pump 20 and directed to the rod side chamber 11*b* of the hydraulic cylinder 10 through the main passage 80*b*. The back-pressure chamber (not shown) of the operation check valve 60*b* is connected to the passage portion 81*a* of the main passage 80*a* via a pilot passage 86*a*. In response to the increase in the pressure in the passage portion 81*a*, the operation check valve 60*a* allows the flow of the working oil from the rod side chamber 11*b* of the hydraulic cylinder 10 to the second port 21*b* of the pump 20 through the main passage 80*b*.

When the working oil is discharged from the first port 21*a* by the pump 20, the working oil from the first port 21*a* pushes the operation check valve 60*a* open. At this time, the pressure in the passage portion 81*a* of the main passage 80*a* is increased, and the operation check valve 60*b* is opened. The working oil from the first port 21*a* is supplied to the counter rod side chamber 11*a* of the hydraulic cylinder 10 through the main passage 80*a*, and the working oil in the rod side chamber 11*b* is discharged to the main passage 80*b* and guided to the second port 21*b* of the pump 20. The hydraulic cylinder 10 is extended by the supply of the working oil to the counter rod side chamber 11*a* and by the discharge of the working oil in the rod side chamber 11*b*.

When the working oil is discharged from the second port 21*b* by the pump 20, the working oil from the second port 21*b* pushes the operation check valve 60*b* open. At this time, the pressure in the passage portion 81*b* of the main passage 80*b* is increased, and the operation check valve 60*a* is opened. The working oil from the second port 21*b* is supplied to the rod side chamber 11*b* of the hydraulic cylinder 10 through the main passage 80*b*, and the working oil in the counter rod side chamber 11*a* is discharged to the main passage 80*a* and guided to the first port 21*a* of the pump 20. The hydraulic cylinder 10 is contracted by the supply of the working oil to the rod side chamber 11*b* and by the discharge of the working oil in the counter rod side chamber 11*a*.

When the pump 20 is being stopped, the pressure in the passage portion 81*a* of the main passage 80*a* and the pressure in the passage portion 81*b* of the main passage 80*b* are not increased. The operation check valve 60*a* and the operation check valve 60*b* are closed, and the flow of the working oil in the main passage 80*a* and the main passage 80*b* is shut off. The working oil in the counter rod side chamber 11*a* and the rod side chamber 11*b* of the hydraulic cylinder 10 is not discharged to the main passage 80*a* and the main passage 80*b*, and the hydraulic cylinder 10 is not operated. In other words, when the pump 20 is being stopped, the hydraulic cylinder 10 is maintained in a stationary state by the operation check valve 60*a* and the operation check valve 60*b*.

In the hydraulic cylinder 10, although the piston rod 13 is inserted through the rod side chamber 11*b*, the piston rod 13 is not inserted through the counter rod side chamber 11*a*. When the piston 12 is moved by the operation of the hydraulic cylinder 10, the flow rate of the working oil flowing between the rod side chamber 11*b* and the main passage 80*b* is less than the flow rate of the working oil flowing between the counter rod side chamber 11*a* and the main passage 80*a*. The volume change caused by the piston rod 13 being advanced/retracted with respect to the cylinder 11 is compensated by a tank 40 connected to the pump 20. The compensation of the volume change will be described more specifically.

The cylinder driving device 100 is provided with a control valve 50 that controls the flow of the working oil between the pump 20 and the tank 40. The tank 40 stores the working oil in a closed space.

The control valve 50 is a three-port-three-position switching valve. A first port of the control valve 50 is connected to a branch passage 91*a* that is branched from the passage portion 81*a* of the main passage 80*a*. A second port of the control valve 50 is connected to a branch passage 91*b* that is branched from the passage portion 81*b* of the main passage 80*b*. A third port of the control valve 50 is connected to a tank passage 91*c* that is connected to the tank 40.

When the control valve 50 is positioned at a first position 50*a*, the communication between the tank passage 91*c* and the branch passage 91*a* is shut off, and the tank passage 91*c* is allowed to communicate with the branch passage 91*b*. When the control valve 50 is positioned at a second position 50*b*, the tank passage 91*c* is allowed to communicate with the branch passage 91*a*, and the communication between the tank passage 91*c* and the branch passage 91*b* is shut off. When the control valve 50 is positioned at a third position 50*c*, the communication between the tank passage 91*c* and the branch passage 91*a* is shut off, and the communication between the tank passage 91*c* and the branch passage 91*b* is shut off.

The position of the control valve 50 is switched by the pressure in the branch passage 91*a* and the branch passage 91*b*. When the pump 20 is being stopped and when the pressure in the branch passage 91*a* and the branch passage 91*b* has not been increased, the control valve 50 is positioned at the third position 50*c* to shut off the communication between the tank passage 91*c* and the branch passage 91*a* and to shut off the communication between the tank passage 91*c* and the branch passage 91*b*.

When the working oil is discharged from the first port 21*a* by the pump 20, as described above, the hydraulic cylinder 10 is extended. At this time, the pressure in the branch passage 91*a* is increased, and the control valve 50 is switched to the first position 50*a*. Then, the tank passage 91*c* is allowed to communicate with the branch passage 91*b*, and thereby, the working oil is allowed to flow between the tank 40 and the passage portion 81*b* of the main passage 80*b*. Because the communication between the tank passage 91*c* and the branch passage 91*a* is shut off, the working oil from the first port 21*a* is supplied to the counter rod side chamber 11*a* of the hydraulic cylinder 10 without flowing into the tank 40.

When the hydraulic cylinder 10 is extended, the flow rate of the working oil discharged from the rod side chamber 11*b* to the main passage 80*b* is less than the flow rate of the working oil supplied from the main passage 80*a* to the counter rod side chamber 11*a* by an amount corresponding to the volume of the piston rod 13 retracting out from the rod side chamber 11*b*. The working oil is supplied from the tank 40 to the passage portion 81*b* of the main passage 80*b* through the tank passage 91*c* and the branch passage 91*b* by the amount corresponding to the volume of the piston rod 13 retracting out from the rod side chamber 11*b*. Therefore, the pump 20 can suck the working oil from the second port 21*b* at the same flow rate as the flow rate of the working oil discharged from the first port 21*a*.

When the working oil is discharged from the second port 21*b* by the pump 20, as described above, the hydraulic cylinder 10 is contracted. At this time, the pressure in the branch passage 91*b* is increased, and the control valve 50 is switched to the second position 50*b*. Then, the tank passage 91*c* is allowed to communicate with the branch passage 91*a*, and thereby, the working oil is allowed to flow between the tank 40 and the passage portion 81*a* of the main passage 80*a*. Because the communication between the tank passage 91*c* and the branch passage 91*b* is shut off, the working oil from the second port 21*b* is supplied to the rod side chamber 11*b* of the hydraulic cylinder 10 without flowing into the tank 40.

When the hydraulic cylinder 10 is contracted, the flow rate of the working oil discharged from the counter rod side chamber 11*a* to the main passage 80*a* is greater than the flow rate of the working oil supplied from the main passage 80*b* to the rod side chamber 11*b* by an amount corresponding to the volume of the piston rod 13 advancing into the rod side chamber 11*b*. The amount of the working oil corresponding to the volume of the piston rod 13 advancing into the rod side chamber 11*b* is discharged from the passage portion 81*a* of the main passage 80*a* to the tank 40 through the branch passage 91*a* and the tank passage 91*c*. Therefore, the pump 20 can suck the working oil from the first port 21*a* at the same flow rate as the flow rate of the working oil discharged from the second port 21*b*.

As described above, the volume change caused by the piston rod 13 being advanced/retracted with respect to the cylinder 11 is compensated by the tank 40 connected to the pump 20.

The cylinder driving device 100 is further provided with a relief valve 96*a*, a relief valve 96*b*, a relief valve 97*a*, and a relief valve 97*b*. The relief valve 96*a* is provided in a relief passage 92*a* that is branched from the passage portion 81*a* of the main passage 80*a* and that is connected to the tank 40. The relief valve 96*a* is opened when the pressure in the passage portion 81*a* reaches the valve opening pressure of the relief valve 96*a*, and the working oil in the passage portion 81*a* is discharged to the tank 40 through the relief passage 92*a*. By providing the relief valve 96*a*, the pressure in the passage portion 81*a* is restricted to a pressure equal to or less than the valve opening pressure of the relief valve 96*a*.

Similarly, the relief valve 96*b* is provided in a relief passage 92*b* that is branched from the passage portion 81*b* of the main passage 80*b* and that is connected to the tank 40, and thereby, the pressure in the passage portion 81*b* is restricted to a pressure equal to or less than the valve opening pressure of the relief valve 96*b*. The relief valve 97*a* is provided in a relief passage 93*a* that is branched from the passage portion 82*a* of the main passage 80*a* and that is connected to the tank 40, and thereby, the pressure in the passage portion 82*a* is restricted to a pressure equal to or less than the valve opening pressure of the relief valve 97*a*. The relief valve 97*b* is provided in a relief passage 93*b* that is branched from the passage portion 82*b* of the main passage 80*b* and that is connected to the tank 40, and thereby, the pressure in the passage portion 82*b* is restricted to a pressure equal to or less than the valve opening pressure of the relief valve 97*b*.

The cylinder driving device 100 is provided with a switching valve 98 that enables a manual operation of the hydraulic cylinder 10. The switching valve 98 is a three-port-two-position switching valve. A first port of the switching valve 98 is connected to a branch passage 94*a* that is branched from the passage portion 82*a* of the main passage 80*a*. A second port of the switching valve 98 is connected to a branch passage 94*b* that is branched from the passage portion 82*b* of the main passage 80*b*. A third port of the switching valve 98 is connected to a tank passage 94*c* that is connected to the tank 40.

When the switching valve 98 is positioned at a first position 98*a*, the communication between the tank passage 94*c* and the branch passage 94*a* is shut off, the communication between the tank passage 94*c* and the branch passage 94*b* is shut off, and the communication between the branch passage 94*a* and the branch passage 94*b* is shut off. When the switching valve 98 is positioned at a second position 98*b*, the tank passage 94*c* is allowed to communicate with the branch passage 94*a*, the tank passage 94*c* is allowed to communicate with the branch passage 94*b*, and the branch passage 94*a* is allowed to communicate with the branch passage 94*b*. The position of the switching valve 98 is switched by manually operating the switching valve 98.

When the switching valve 98 is switched to the second position 98*b*, the counter rod side chamber 11*a* and the rod side chamber 11*b* of the hydraulic cylinder 10 are connected to the tank 40 by bypassing the operation check valves 60*a* and 60*b*, and the control valve 50. The hydraulic cylinder 10 can be extended/contracted by the manual operation.

The restriction valve 70*b* restricts the flow of the working oil in the main passage 80*b*. The flow of the working oil in the restriction valve 70*b* is restricted in accordance with the opening area of the restriction valve 70*b*. Therefore, the flow rate of the working oil discharged from the rod side chamber 11*b* to the main passage 80*b* is restricted, and thereby, it is possible to prevent a hunting phenomenon during the extending operation of the hydraulic cylinder 10.

In this description, the hunting phenomenon means a phenomenon in which the hydraulic cylinder 10 is repeatedly operated and stopped even during the operation of the pump 20. The hunting phenomenon will be described in detail with reference to FIG. 11.

Figure 11:
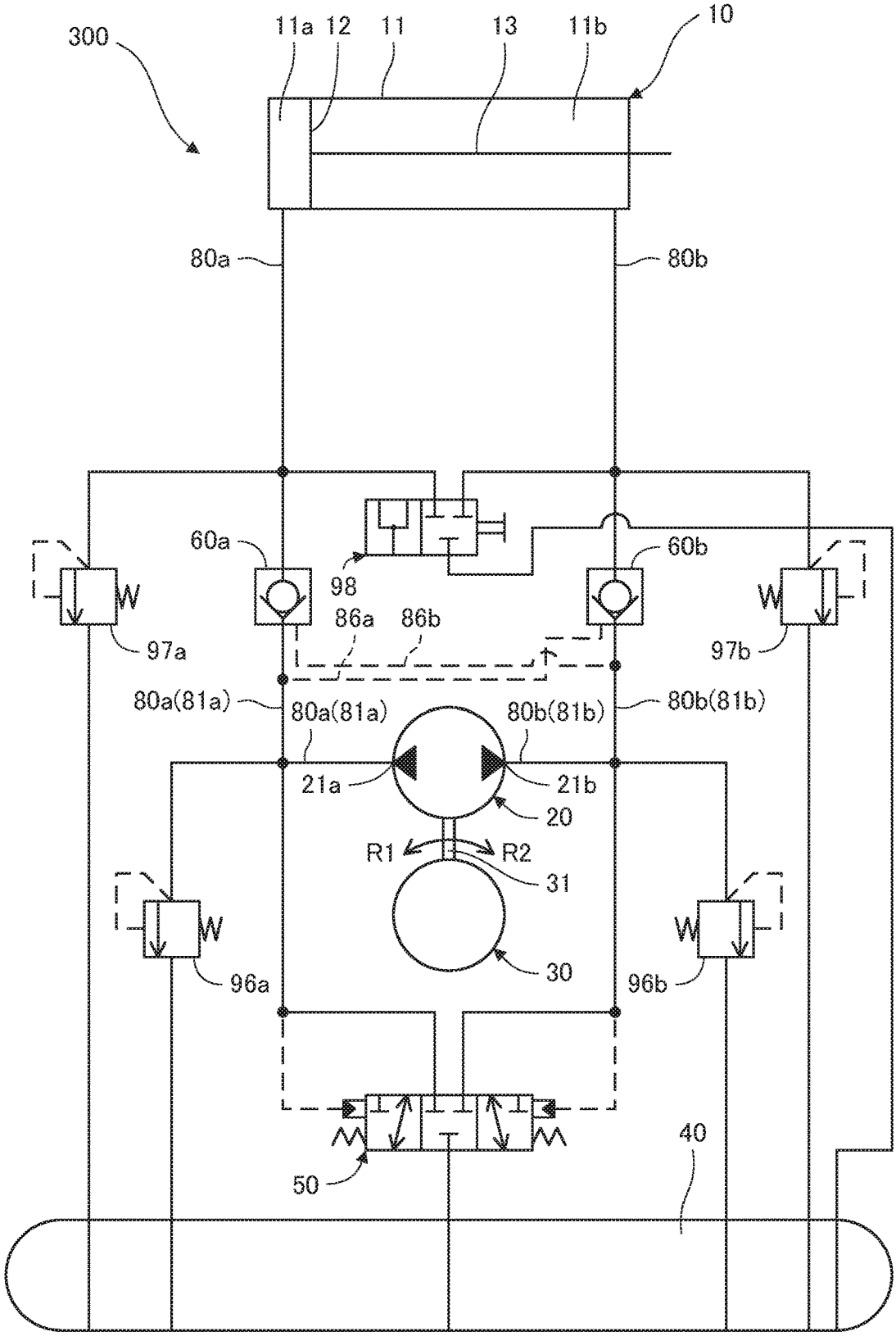
FIG. 11 is a circuit diagram of the cylinder driving device according to a comparative example.

FIG. 11 is a circuit diagram of a cylinder driving device 300 according to a comparative example. Configurations that are the same as those of the cylinder driving device 100 are assigned the same reference signs, and descriptions thereof shall be omitted. The cylinder driving device 300 differs from the cylinder driving device 100 in that the restriction valve 70*a* and the restriction valve 70*b* are not provided (see FIG. 4).

An operation of the cylinder driving device 300 under a condition in which the hunting phenomenon does not occur will be described first. More specifically, a description will be given of the operation of the cylinder driving device 300 when the hydraulic cylinder 10 is extended in a state in which the piston rod 13 is receiving an the external force due to the load in the contracting direction (a state shown in FIG. 2).

Because the external force due to the load is exerted to the piston 12 in the contracting direction via the piston rod 13, the piston 12 does not move in the extending direction with this external force. The working oil supplied to the counter rod side chamber 11*a* causes the piston 12 to move in the extending direction against the external force.

The pressure in the main passage 80*a* is kept at a high state by the working oil discharged from the first port 21*a* of the pump 20, and so, the operation check valve 60*b* is kept in the opened state. Therefore, the working oil in the rod side chamber 11*b* is continued to be discharged to the main passage 80*b*, and the hydraulic cylinder 10 is continued to be extended without being stopped.

As described above, when the hydraulic cylinder 10 is extended in a state in which the piston rod 13 is receiving the external force due to the load in the contracting direction (a state shown in FIG. 2), the hydraulic cylinder 10 is continued to be extended.

Similarly, also when the hydraulic cylinder 10 is contracted in a state in which the piston rod 13 is receiving the external force due to the load in the extending direction (a state shown in FIG. 3), the hydraulic cylinder 10 is continued to be contracted without being stopped. In other words, the hunting phenomenon does not occur if the direction in which the external force due to the load is exerted to the piston rod 13 does not match the operating direction of the hydraulic cylinder 10.

Next, the operation of the cylinder driving device 300 under the condition in which the hunting phenomenon occurs will be described. More specifically, a description will be given of the operation of the cylinder driving device 300 when the hydraulic cylinder 10 is extended in a state in which the piston rod 13 is receiving the external force due to the load in the extending direction (a state shown in FIG. 3).

Soon after the working oil is discharged from the first port 21*a* by the pump 20, the working oil from the first port 21*a* pushes the operation check valve 60*a* open and is supplied to the counter rod side chamber 11*a* of the hydraulic cylinder 10. At this time, the pressure in the passage portion 81*a* of the main passage 80*a* is increased, and the operation check valve 60*b* is opened. The working oil in the rod side chamber 11*b* is discharged to the main passage 80*b*, and the hydraulic cylinder 10 starts to extend.

Because the external force due to the load is exerted to the piston 12 in the extending direction via the piston rod 13, the piston 12 is moved in the extending direction by receiving the external force in addition to the pressure of the working oil supplied to the counter rod side chamber 11*a*. The larger the external force due to the load is, the faster the moving speed of the piston 12 is, and the greater the flow rate of the working oil discharged from the rod side chamber 11*b* to the main passage 80*b* becomes.

As the piston 12 is moved at high speed in the direction in which the hydraulic cylinder 10 is extended, the working oil in the main passage 80*a* is sucked to the counter rod side chamber 11*a* by the piston 12. In other words, with the external force due to the load, the hydraulic cylinder 10 functions as a pump and sucks the working oil in the main passage 80*a*.

When the flow rate of the working oil sucked from the main passage 80*a* by the hydraulic cylinder 10 exceeds the maximum discharge flow rate of the pump 20, the pump 20 can no longer increase the pressure in the main passage 80*a*, and the pressure in the passage portion 81*a* of the main passage 80*a* is decreased. Thereby, the operation check valve 60*b* is closed, and the discharge of the working oil from the rod side chamber 11*b* to the main passage 80*b* is stopped. The piston 12 is stopped, and the hydraulic cylinder 10 is stopped.

When the piston 12 is stopped, the suction of the working oil from the main passage 80*a* to the counter rod side chamber 11*a* by the piston 12 is stopped. The pressure in the main passage 80*a* is increased by the pump 20, and the operation check valve 60*b* is opened. The working oil in the rod side chamber 11*b* is discharged to the main passage 80*b*, and the hydraulic cylinder 10 starts to extend again.

The piston 12 is moved in the extending direction by receiving the external force due to the load in addition to the pressure of the working oil supplied to the counter rod side chamber 11*a*. The working oil in the main passage 80*a* is sucked to the counter rod side chamber 11*a* by the piston 12, and the pressure in the passage portion 81*a* of the main passage 80*a* is decreased. The operation check valve 60*b* is closed, and the discharge of the working oil from the rod side chamber 11*b* to the main passage 80*b* is stopped. The piston 12 is stopped, and the hydraulic cylinder 10 is stopped again.

As described above, with the cylinder driving device 300, the hydraulic cylinder 10 is repeatedly extended and stopped when the hydraulic cylinder 10 is extended in a state in which the piston rod 13 is receiving the large external force due to the load in the extending direction (a state shown in FIG. 3).

Similarly, the hydraulic cylinder 10 is also repeatedly contracted and stopped even when the hydraulic cylinder 10 is contracted in a state in which the piston rod 13 is receiving the large external force due to the load in the contracting direction (a state shown in FIG. 2). In other words, with the cylinder driving device 300, the hunting phenomenon is caused when the direction in which the external force due to the load is exerted to the piston rod 13 matches the operating direction of the hydraulic cylinder 10.

When referring to FIG. 4, with the cylinder driving device 100, the flow of the working oil discharged from the rod side chamber 11*b* to the main passage 80*b* is restricted by the restriction valve 70*b*. Even when the hydraulic cylinder 10 is extended in a state in which the external force due to the load is exerted to the piston rod 13 in the extending direction, the increase in the flow rate of the working oil discharged from the rod side chamber 11*b* of the hydraulic cylinder 10 to the main passage 80*b* is restricted. It is possible to prevent the suction of the working oil from the main passage 80*a* to the counter rod side chamber 11*a* by the piston 12 and to prevent the decrease in the pressure in the main passage 80*a*. Therefore, it is possible to prevent the occurrence of the hunting phenomenon during the extending operation of the hydraulic cylinder 10.

Similarly, the flow of the working oil discharged from the counter rod side chamber 11*a* to the main passage 80*a* is restricted by the restriction valve 70*a*. The increase in the flow rate of the working oil discharged from the counter rod side chamber 11*a* of the hydraulic cylinder 10 to the main passage 80*a* is restricted. It is possible to prevent the decrease in the pressure in the main passage 80*b* and to prevent the occurrence of the hunting phenomenon during the contracting operation of the hydraulic cylinder 10.

The restriction valve 70*b* is formed such that the opening area of the restriction valve 70*b* is reduced in response to the increase in the flow rate of the working oil discharged from the rod side chamber 11*b* of the hydraulic cylinder 10 to the main passage 80*b*.

Figure 5:
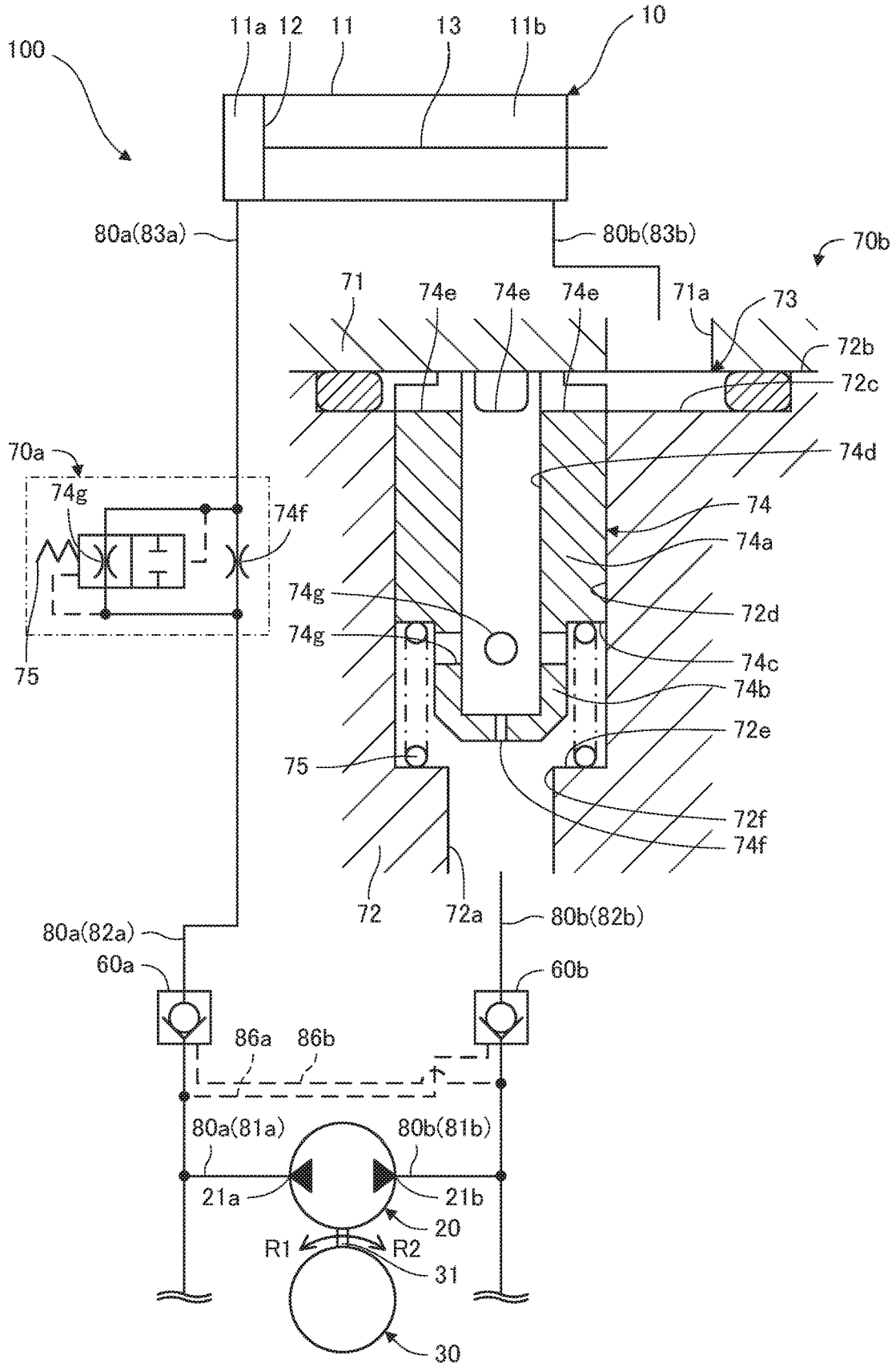
FIG. 5 is a schematic sectional view of a restriction valve shown in FIG. 4.

FIG. 5 is a schematic sectional view of the restriction valve 70*b*. The restriction valve 70*b* has a first port 71*a* that is connected to the passage portion 83*b* of the main passage 80*b*, a second port 72*a* that is connected to the passage portion 82*b* of the main passage 80*b*, and a flow passage 73 through which the first port 71*a* is communicated with the second port 72*a*. The first port 71*a* is formed by a circular hole that is formed in a first housing 71. The second port 72*a* is formed by a circular hole that is formed in a second housing 72.

The second housing 72 has an opposing surface 72*b* that opposes the first housing 71. The opposing surface 72*b* is formed with a hollow portion 72*c*. The first port 71*a* is in communication with the hollow portion 72*c*.

The second housing 72 is formed with a hole 72*d* that opens at a bottom surface of the hollow portion 72*c*. The inner diameter of the hole 72*d* is larger than the inner diameter of the second port 72*a*, and the second port 72*a* opens at a bottom surface 72*e* of the hole 72*d*. The flow passage 73 is formed by the hollow portion 72*c* and the hole 72*d*. An annular valve seat 72*f* is formed by the bottom surface 72*e* of the hole 72*d* and an inner circumferential surface of the second port 72*a*.

The restriction valve 70*b* has a valve body 74 that is provided in the flow passage 73 and a spring (a biasing member) 75 that biases the valve body 74 in the direction in which the valve body 74 is separated from the valve seat 72*f*. The spring 75 is, for example, a coil spring.

The valve body 74 has a large-diameter portion 74*a* that has the outer diameter that is substantially the same as the inner diameter of the hole 72*d* and a small-diameter portion 74*b* that has the outer diameter smaller than the outer diameter of the large-diameter portion 74*a*. The large-diameter portion 74*a* is slidably accommodated in the hole 72*d*.

The small-diameter portion 74*b* projects from the large-diameter portion 74*a* towards the second port 72*a*. A step portion 74*c* is formed between the large-diameter portion 74*a* and the small-diameter portion 74*b*.

The outer diameter of a proximal end portion of the small-diameter portion 74*b* (a portion that continued from the large-diameter portion 74*a*) is larger than the inner diameter of the second port 72*a*. The outer diameter of a distal end surface of the small-diameter portion 74*b* is smaller than the inner diameter of the second port 72*a*. A distal end portion of the small-diameter portion 74*b* is formed to have a tapered shape. When the valve body 74 is seated on the valve seat 72*f*, the distal end surface of the small-diameter portion 74*b* enters the second port 72*a*, and the distal end portion of the small-diameter portion 74*b* is brought into contact with the valve seat 72*f*.

The spring 75 is provided between the step portion 74*c* of the valve body 74 and the bottom surface 72*e* of the hole 72*d* in a compressed state. The valve body 74 is biased in the direction in which the valve body 74 is separated from the valve seat 72*f* by a restoring force of the spring 75. The movement of the valve body 74 in the direction in which the valve body 74 is separated from the valve seat 72*f* is restricted by the first housing 71.

The valve body 74 is formed with a hole 74*d* that opens at an end surface of the large-diameter portion 74*a* and that is formed so as to extend from the large-diameter portion 74*a* to the small-diameter portion 74*b*. The end surface of the large-diameter portion 74*a* is formed with a groove 74*e* that extends from an inner circumferential surface of the hole 74*d* to an outer circumferential surface of the large-diameter portion 74*a*. Through the groove 74*e*, the hole 74*d* is communicated with the hollow portion 72*c* even in a state in which the valve body 74 is pushed against the first housing 71.

The small-diameter portion 74*b* is formed with a restriction hole (first restriction portion) 74*f* that penetrates between a bottom surface of the hole 74*d* and the distal end surface of the small-diameter portion 74*b*. The small-diameter portion 74*b* is formed with a restriction hole (second restriction portion) 74*g* that penetrates between the inner circumferential surface of the hole 74*d* and an outer circumferential surface of the small-diameter portion 74*b*. In a state in which the valve body 74 is seated on the valve seat 72*f*, the working oil flows between the second port 72*a* and the hole 74*d* only through the restriction hole 74*f* and not through the restriction hole 74*g*.

In a state in which the pump 20 is stopped, the pressure of the working oil does not act on the valve body 74, and the valve body 74 is separated from the valve seat 72*f* by the biasing force exerted by the spring 75. When the working oil is discharged from the second port 21*b* by the pump 20, the valve body 74 is separated from the valve seat 72*f* by the pressure of the working oil directed from the second port 72*a* to the first port 71*a* through the flow passage 73 and by the biasing force exerted by the spring 75.

Figure 6:
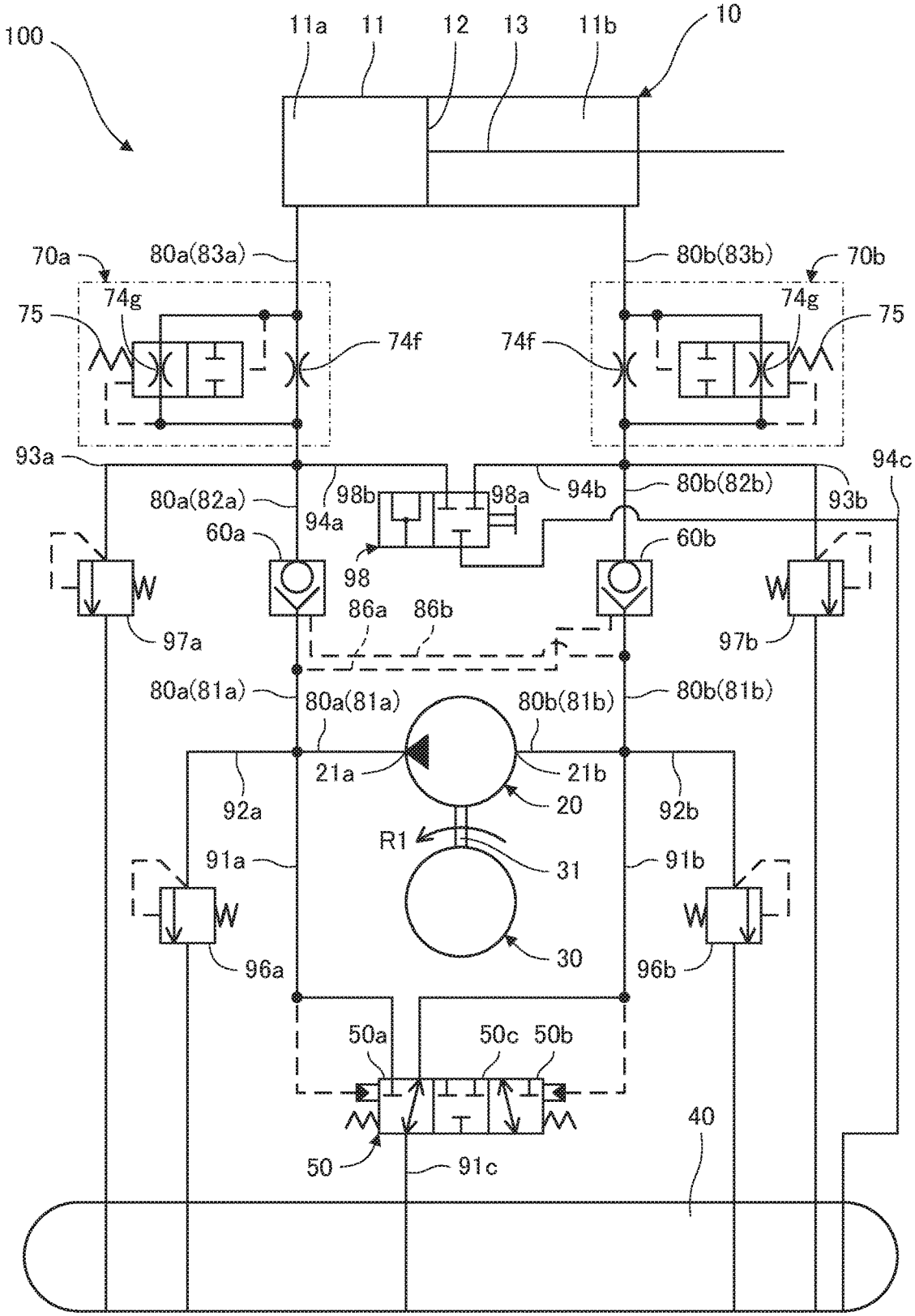
FIG. 6 is a circuit diagram of the cylinder driving device according to the embodiment of the present invention and shows a state in which an the external force due to a load is exerted to a fluid pressure cylinder in the contracting direction and in which a pump is operated such that the fluid pressure cylinder is extended.

In a state in which the external force due to the load is exerted to the piston rod 13 in the contracting direction (a state shown in FIG. 2), when the working oil is discharged from the first port 21*a* by the pump 20, the hydraulic cylinder 10 is extended against the external force due to the load by the pump 20 (see FIG. 6). At this time, the flow rate of the working oil discharged from the rod side chamber 11*b* to the main passage 80*b* is low.

Figure 7:
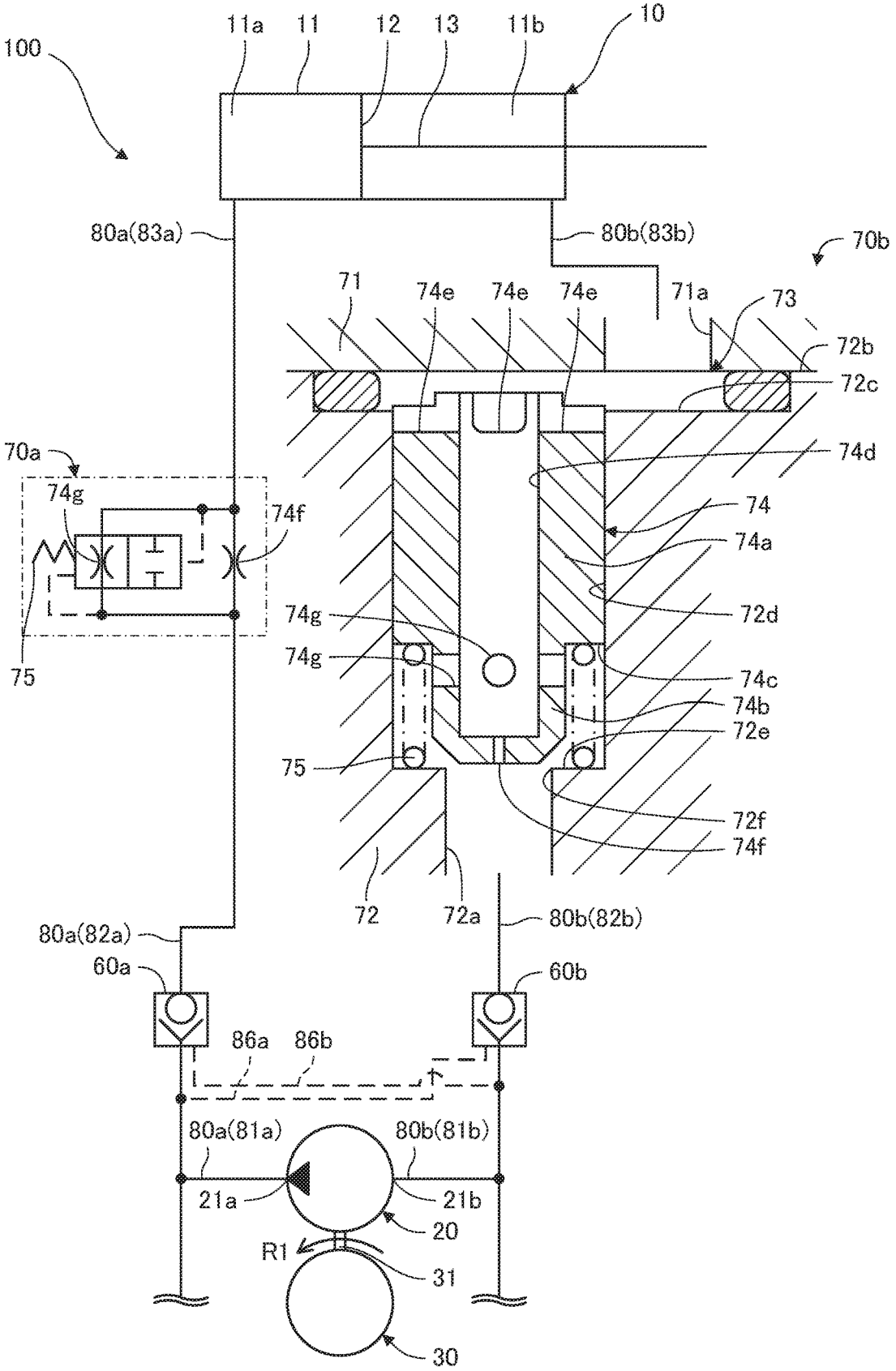
FIG. 7 is a schematic view of the restriction valve shown in FIG. 6.

As shown in FIG. 7, the working oil supplied from the first port 71*a* of the restriction valve 70*b* causes the valve body 74 to approach the valve seat 72*f* against the biasing force exerted by the spring 75. However, because the flow rate of the working oil supplied from the first port 71*a* of the restriction valve 70*b* is low, the pressure difference between the first port 71*a* and the second port 72*a* is small. Thus, the movement of the valve body 74 is restricted by the biasing force exerted by the spring 75, and the valve body 74 does not seat on the valve seat 72*f*. In other words, the valve body 74 is kept in a state in which it is separated from the valve seat 72*f*.

The first port 71*a* of the restriction valve 70*b* is communicated with the second port 72*a* through both of the restriction hole 74*f* and the restriction hole 74*g*. In other words, the opening area of the restriction valve 70*b* corresponds to a total sum of the opening area of the restriction hole 74*f* and the opening area of the restriction hole 74*g*. The opening area of the restriction valve 70*b* is large, and so, a resistance imparted to the flow of the working oil by the restriction valve 70*b* in the main passage 80*b* is small. Therefore, it is possible to reduce the load on the electric motor 30 and to reduce the electric power consumption of the electric motor 30.

In addition, because the load on the electric motor 30 is made small, the low power electric motor 30 can be used. Thus, a cost for the electric motor 30 and electric equipment for supplying electrical power to the electric motor 30 can be reduced.

Furthermore, because a resistance imparted to the flow of the working oil by the restriction valve 70*b* in the main passage 80*b* is small, it is possible to increase the speed of the operation of the hydraulic cylinder 10 without increasing the power of the electric motor 30.

At this time, because the external force due to the load is not exerted in the direction in which the hydraulic cylinder 10 is extended, the hydraulic cylinder 10 is prevented from functioning as a pump to suck the working oil in the main passage 80*a*. Thus, the pressure in the main passage 80*a* is increased by the pump 20, and the operation check valve 60*b* is kept in the opened state. Therefore, the hunting phenomenon does not occur.

Figure 8:
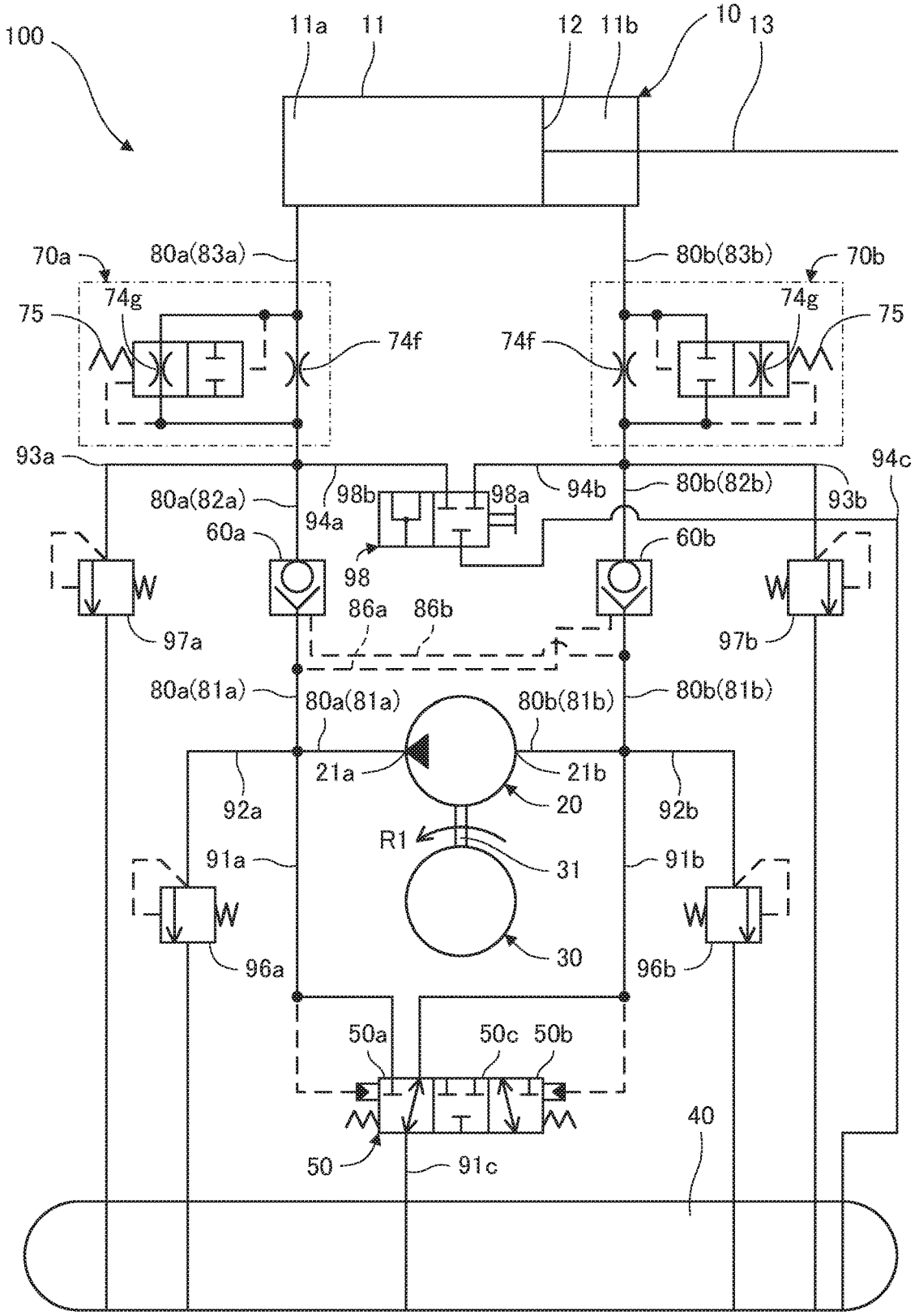
FIG. 8 is a circuit diagram of the cylinder driving device according to the embodiment of the present invention, and shows a state in which the external force due to the load is exerted to the fluid pressure cylinder in the extending direction and in which the pump is operated such that the fluid pressure cylinder is extended.

In a state in which the external force due to the load is exerted to the piston rod 13 in the extending direction (a state shown in FIG. 3), when the working oil is discharged from the first port 21*a* by the pump 20, the hydraulic cylinder 10 is extended by the pump 20 together with the external force due to the load (see FIG. 8). Thus, the flow rate of the working oil discharged from the rod side chamber 11*b* to the main passage 80*b* is increased.

Figure 9:
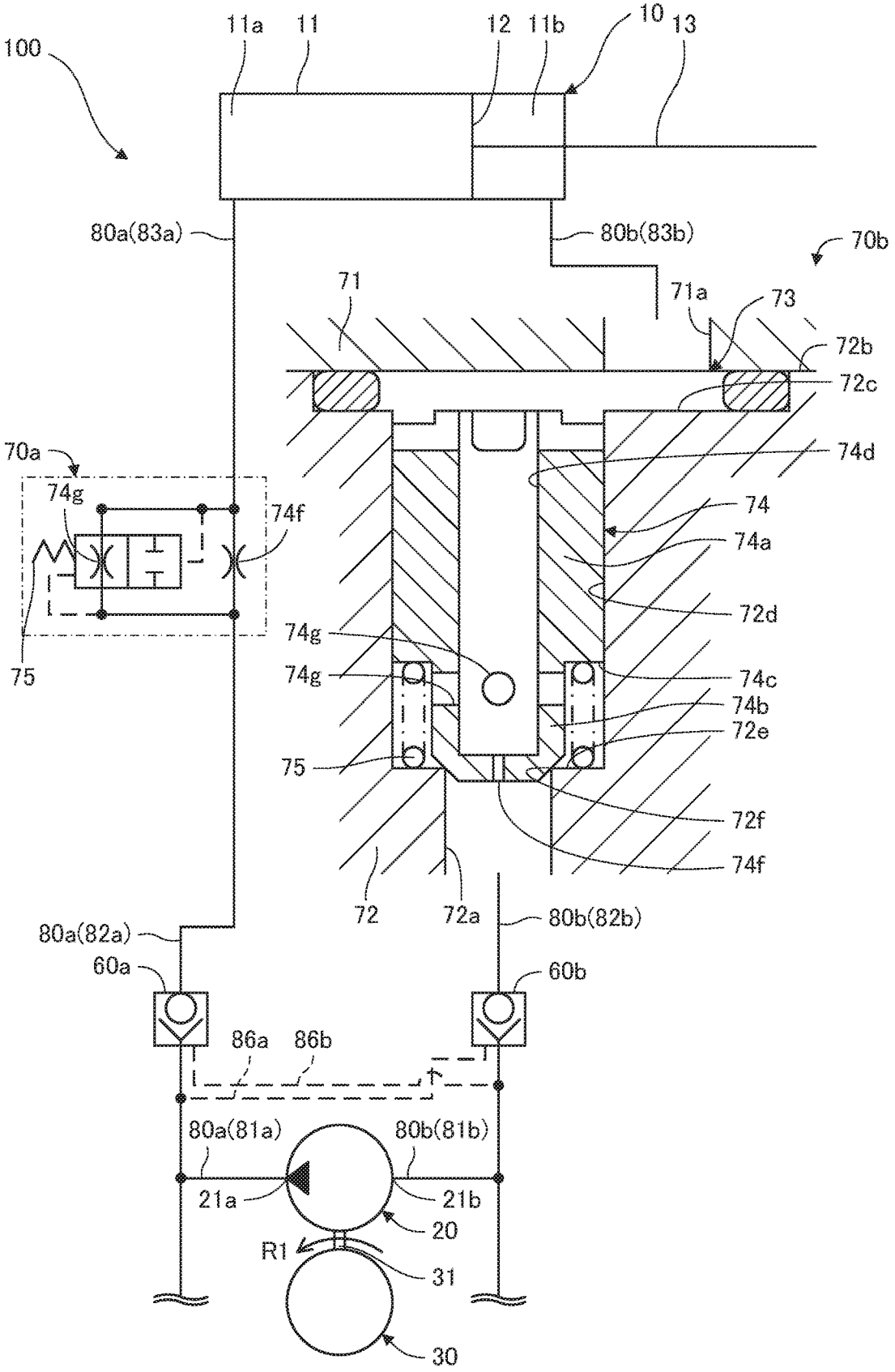
FIG. 9 is a schematic view of the restriction valve shown in FIG. 8.

As shown in FIG. 9, the working oil supplied from the first port 71*a* of the restriction valve 70*b* causes the valve body 74 to approach the valve seat 72*f* against the biasing force exerted by the spring 75. Because the flow rate of the working oil supplied from the first port 71*a* of the restriction valve 70*b* is high, the pressure difference between the first port 71*a* and the second port 72*a* is large. Thus, the valve body 74 is made to seat on the valve seat 72*f* against the biasing force exerted by the spring 75.

The first port 71*a* of the restriction valve 70*b* is communicated with the second port 72*a* only through the restriction hole 74*f*, and the first port 71*a* is not communicated with the second port 72*a* through the restriction hole 74*g*. In other words, the opening area of the restriction valve 70*b* corresponds to the opening area of the restriction hole 74*f*.

At this time, the opening area of the restriction valve 70*b* is small, and the flow of the working oil in the main passage 80*b* is restricted by the restriction valve 70*b* to a greater extent. Thus, the increase in the flow rate of the working oil in the main passage 80*b* is restricted, and it is possible to prevent the hydraulic cylinder 10 from functioning as a pump to suck the working oil in the main passage 80*a*. Therefore, the pressure in the main passage 80*a* can be increased by the pump 20, and it is possible to keep the operation check valve 60*b* in the opened state. Thus, it is possible to prevent the occurrence of the hunting phenomenon.

At this time, because the external force due to the load is exerted in the direction in which the hydraulic cylinder 10 is extended, the load of the pump 20 is made small. Therefore, it is possible to reduce the load on the electric motor 30 and to reduce the electric power consumption of the electric motor 30.

As described above, in the cylinder driving device 100, the opening area of the restriction valve 70*b* is changed between a case in which the external force is exerted to the hydraulic cylinder 10 such that the hunting phenomenon is caused and a case in which the external force is exerted to the hydraulic cylinder 10 such that the hunting phenomenon is not caused. Therefore, during the extending operation of the hydraulic cylinder 10, it is possible to reduce the electric power consumption of the electric motor 30 and to prevent the occurrence of the hunting phenomenon.

Similarly to the restriction valve 70*b*, the restriction valve 70*a* is formed such that the opening area of the restriction valve 70*a* is reduced in response to the increase in the flow rate of the working oil discharged from the counter rod side chamber 11*a* of the hydraulic cylinder 10 to the main passage 80*a*. Therefore, during the contracting operation of the hydraulic cylinder 10, it is possible to reduce the electric power consumption of the electric motor 30 and to prevent the occurrence of the hunting phenomenon.

The configuration of the restriction valve 70*a* is substantially the same as the configuration of the restriction valve 70*b*, and so, a description thereof shall be omitted.

The restriction valve 70*b* is set such that the opening area of the restriction valve 70*b* is reduced when the flow rate of the working oil sucked from the main passage 80*a* by the hydraulic cylinder 10 reaches the maximum discharge flow rate of the pump 20.

Until the flow rate of the working oil sucked from the main passage 80*a* by the hydraulic cylinder 10 reaches the maximum discharge flow rate of the pump 20, the opening area of the restriction valve 70*b* is large. Therefore, the load on the electric motor 30 is small, and so, it is possible to reduce the electric power consumption of the electric motor 30.

When the flow rate of the working oil sucked from the main passage 80*a* by the hydraulic cylinder 10 reaches the maximum discharge flow rate of the pump 20, the opening area of the restriction valve 70*b* is decreased, and the restriction valve 70*b* restricts the increase in the flow rate. Therefore, it is possible to prevent the hydraulic cylinder 10 from functioning as a pump to suck the working oil in the main passage 80*a*, and it is possible to prevent the occurrence of the hunting phenomenon.

The settings of the restriction valve 70*b* can be changed by changing a spring constant of the spring 75, the opening area of the restriction hole 74*f*, and the opening area of the restriction hole 74*g*.

Similarly to the restriction valve 70*b*, the restriction valve 70*a* is set such that the opening area of the restriction valve 70*a* is reduced when the flow rate of the working oil sucked from the main passage 80*b* by the hydraulic cylinder 10 reaches the maximum discharge flow rate of the pump 20.

The opening area of the restriction hole 74*g* is larger than the opening area of the restriction hole 74*f*. Thus, a difference between the opening area of the restriction valve 70*b* in a case in which both of the restriction hole 74*f* and the restriction hole 74*g* allow the communication between the first port 71*a* and the second port 72*a*, and the opening area of the restriction valve 70*b* in a case in which only the restriction hole 74*f* allows the communication between the first port 71*a* and the second port 72*a* is increased. Therefore, it is possible to further reduce the opening area of the restriction valve 70*b* in response to the increase in the flow rate of the working oil discharged from the rod side chamber 11*b* of the hydraulic cylinder 10 to the main passage 80*b*.

The hydraulic cylinder 10, the pump 20, the electric motor 30, the tank 40, various passages, and various valves form one unit (see FIG. 1). Thus, the hydraulic cylinder 10 can be operated only by supplying the electrical power to the electric motor 30 without connecting pipes, etc. to the hydraulic cylinder 10. Therefore, the operability of the cylinder driving device 100 is improved.

The hydraulic cylinder 10, the pump 20, the electric motor 30, the tank 40, the various passages, and the various valves may not form a unit. For example, the pump 20 may be installed at a position separated from the hydraulic cylinder 10, and the pump 20 may be connected to the hydraulic cylinder 10 through pipes Next, operations of the cylinder driving device 100 and the rotating device 1000 will be described with reference to FIGS. 1 to 9.

When the output shaft 31 of the electric motor 30 is rotated in the forward direction R1, the pump 20 discharges the working oil from the first port 21*a*. The working oil from the pump 20 pushes the operation check valve 60*a* open and is guided to the restriction valve 70*a*.

The valve body of the restriction valve 70*a* receives a force from the working oil in the direction in which the valve body is separated from the valve seat, and thereby, a state in which the valve body is separated from the valve seat is maintained. In the restriction valve 70*a*, the passage portion 82*a* of the main passage 80*a* is communicated with the passage portion 83*a* through the restriction hole 74*f* and the restriction hole 74*g*. The working oil in the passage portion 82*a* of the main passage 80*a* is supplied to the counter rod side chamber 11*a* of the hydraulic cylinder 10 through the restriction hole 74*f* and the restriction hole 74*g* of the restriction valve 70*a*.

At this time, the opening area of the restriction valve 70*a* corresponds to a total sum of the opening area of the restriction hole 74*f* and the opening area of the restriction hole 74*g*, and the resistance imparted to the flow of the working oil in the main passage 80*a* by the restriction valve 70*a* is small.

In addition, the pressure in the passage portion 81*a* of the main passage 80*a* is increased, and the operation check valve 60*b* is opened. The working oil in the rod side chamber 11*b* of the hydraulic cylinder 10 is discharged to the main passage 80*b*, and thereby, the hydraulic cylinder 10 is extended. The working oil that has been discharged to the main passage 80*b* is guided to the second port 21*b* of the pump 20.

In a state in which the external force due to the load is exerted to the piston rod 13 in the contracting direction (a state shown in FIGS. 1 and 2), the piston 12 is not moved in the extending direction by the external force. The flow rate of the working oil discharged from the rod side chamber 11*b* to the main passage 80*b* is low, and so, the valve body 74 of the restriction valve 70*b* is kept in a state in which it is separated from the valve seat 72*f* (see FIGS. 6 and 7). The working oil in the passage portion 83*b* of the main passage 80*b* is guided to the passage portion 82*b* of the main passage 80*b* through the restriction hole 74*f* and the restriction hole 74*g* of the restriction valve 70*b*.

In the restriction valve 70*b*, because the passage portion 83*b* of the main passage 80*b* is communicated with the passage portion 82*b* through the restriction hole 74*f* and the restriction hole 74*g*, the opening area of the restriction valve 70*b* is large, and so, a resistance imparted to the flow of the working oil by the restriction valve 70*b* in the main passage 80*b* is small.

Because the resistance imparted to the flow of the working oil in the main passage 80*a* and the main passage 80*b* is small, it is possible to reduce the load on the electric motor 30. Therefore, it is possible to reduce the electric power consumption of the electric motor 30.

Because the external force due to the load is not exerted in the direction in which the hydraulic cylinder 10 is extended, even when the opening area of the restriction valve 70*b* is large, the hunting phenomenon does not occur.

As the hydraulic cylinder 10 is extended, the external force due to the load starts to be exerted to the piston rod 13 in the extending direction (see FIG. 3). The piston 12 is moved in the extending direction also by this external force. The flow rate of the working oil discharged from the rod side chamber 11*b* to the main passage 80*b* is increased, and the valve body 74 of the restriction valve 70*b* is made to seat on the valve seat 72*f* against the biasing force exerted by the spring 75 (see FIGS. 8 and 9).

In the restriction valve 70*b*, the passage portion 83*b* of the main passage 80*b* is communicated with the passage portion 82*b* only through the restriction hole 74*f*. The opening area of the restriction valve 70*b* corresponds to the opening area of the restriction hole 74*f*, and the flow of the working oil in the main passage 80*b* is restricted by the restriction valve 70*b*.

The increase in the flow rate of the working oil in the main passage 80*b* is restricted, and it is possible to prevent the hydraulic cylinder 10 from functioning as a pump to suck the working oil in the main passage 80*a*. The pressure in the main passage 80*a* can be increased by the pump 20, and it is possible to keep the operation check valve 60*b* in the opened state. Therefore, it is possible to prevent the occurrence of the hunting phenomenon.

At this time, because the external force due to the load is exerted in direction in which the hydraulic cylinder 10 is extended, the load of the pump 20 is made small. Therefore, it is possible to reduce the load on the electric motor 30 and to reduce the electric power consumption of the electric motor 30.

As described above, with the cylinder driving device 100, it is possible to reduce the electric power consumption of the electric motor 30 and to prevent the occurrence of the hunting phenomenon.

The contracting operation of the hydraulic cylinder 10 is substantially the same as the extending operation, and so, a description thereof shall be omitted.

Figure 10:
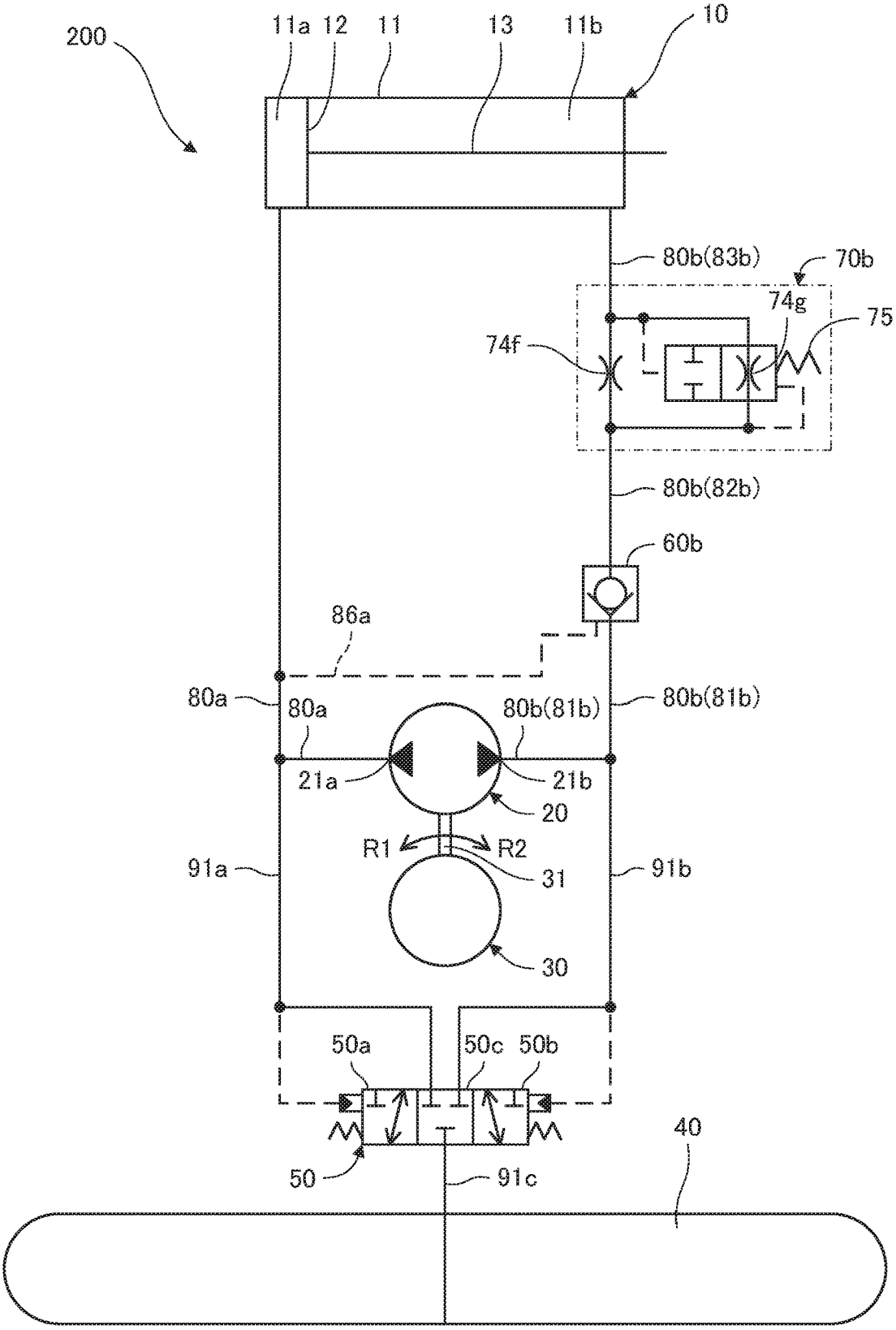
FIG. 10 is a circuit diagram of the cylinder driving device according to a modification of the embodiment of the present invention.

FIG. 10 is a circuit diagram of a cylinder driving device 200 according to a modification. The cylinder driving device 200 differs from the cylinder driving device 100 mainly in that the operation check valve 60*a* and the restriction valve 70*a* are not provided (see FIG. 4). Also with the cylinder driving device 200, it is possible to prevent the occurrence of the hunting phenomenon during the extending operation.

Although an illustration is omitted, the cylinder driving device is provided with the operation check valve 60*a* and the restriction valve 70*a* (see FIG. 4), but may not be provided with the operation check valve 60*b* and the restriction valve 70*b*. In this case, it is possible to prevent the occurrence of the hunting phenomenon during the contracted operation.

In the following, configurations, actions, and effects of the embodiment of the present invention will be described collectively.

In this embodiment, the cylinder driving device (100, 200) includes: the electric motor 30; the pump 20 configured to be driven by the electric motor 30 and discharge the working oil; the main passage 80*a* and the main passage 80*b* respectively connected to the pump 20, the main passage 80*a* and the main passage 80*b* being configured to selectively guide the working oil from the pump 20; the hydraulic cylinder 10 connected to the main passage 80*a* and the main passage 80*b*, the hydraulic cylinder 10 being configured to be operated by the working oil supplied from the one of the main passage 80*a* and the main passage 80*b*, the hydraulic cylinder 10 being configured to discharge the working oil to the other of the main passage 80*a* and the main passage 80*b* when operated; the operation check valve 60*b* and the operation check valve 60*a* respectively provided in the main passage 80*b* and the main passage 80*a*, the operation check valve 60*b* and the operation check valve 60*a* being configured to allow the flow of the working oil directed from the hydraulic cylinder 10 to the pump 20 in response to the increase in the pressure in the main passage 80*a* and the main passage 80*b* while allowing the flow of the working oil directed from the pump 20 to the hydraulic cylinder 10; and the restriction valve 70*b* and the restriction valve 70*a* respectively provided between the hydraulic cylinder 10 and the operation check valves 60*b* and 60*a* in the main passage 80*b* and the main passage 80*a*, the restriction valve 70*b* and the restriction valve 70*a* being configured to restrict the flow of the working oil directed from the hydraulic cylinder 10 to the operation check valve 60*b* and the operation check valve 60*a*, wherein the opening areas of the restriction valve 70*b* and the restriction valve 70*a* are reduced in response to the increase in the flow rate of the working oil discharged from the hydraulic cylinder 10 to the main passage 80*b* and the main passage 80*a*.

With this configuration, the opening areas of the restriction valve 70*b* and the restriction valve 70*a* are reduced in response to the increase in the flow rate of the working oil discharged from the hydraulic cylinder 10 to the main passage 80*b* and the main passage 80*a*. When the external force due to the load is exerted to the hydraulic cylinder 10 such that the hunting phenomenon is not caused, the flow rate of the working oil discharged from the hydraulic cylinder 10 to the main passage 80*b* and the main passage 80*a* is low. Thus, the opening areas of the restriction valve 70*b* and the restriction valve 70*a* are large, and so, it is possible to reduce the load on the electric motor 30. When the external force due to the load is exerted to the hydraulic cylinder 10 such that the hunting phenomenon is caused, the flow rate of the working oil discharged from the hydraulic cylinder 10 to the main passage 80*b* and the main passage 80*a* is increased, while the opening areas of the restriction valve 70*b* and the restriction valve 70*a* are reduced. The increase in the flow rate of the working oil in the main passage 80*b* and the main passage 80*a* is restricted, and so, it is possible to prevent the hydraulic cylinder 10 from functioning as the pump 20. Therefore, it is possible to reduce the electrical power of the electric motor 30 and to prevent the occurrence of the hunting phenomenon.

In addition, in this embodiment, the restriction valve 70*b* and the restriction valve 70*a* are set such that the opening areas are reduced when the flow rate of the working oil sucked from the main passage 80*a* and the main passage 80*b* by the hydraulic cylinder 10 reaches the maximum discharge flow rate of the pump 20.

With this configuration, the opening areas of the restriction valve 70*b* and the restriction valve 70*a* are reduced when the flow rate of the working oil sucked from the main passage 80*a* and the main passage 80*b* by the hydraulic cylinder 10 reaches the maximum discharge flow rate of the pump 20. Until the flow rate of the working oil sucked from the main passage 80*a* and the main passage 80*b* by the hydraulic cylinder 10 reaches the maximum discharge flow rate of the pump 20, the opening areas of the restriction valve 70*b* and the restriction valve 70*a* are large. Therefore, the load on the electric motor 30 is small, and so, it is possible to reduce the electric power consumption of the electric motor 30. In addition, when the flow rate of the working oil sucked from the main passage 80*a* and the main passage 80*b* by the hydraulic cylinder 10 reaches the maximum discharge flow rate of the pump 20, the opening areas of the restriction valve 70*b* and the restriction valve 70*a* are reduced, and the increase in the flow rate is restricted. Therefore, it is possible to prevent the hydraulic cylinder 10 from functioning as the pump 20 and to prevent the occurrence of the hunting phenomenon.

In addition, in this embodiment, the cylinder driving device (100, 200) is characterized in that the restriction valve 70*b* and the restriction valve 70*a* have: the first port 71*a* connected to the hydraulic cylinder 10; the second port 72*a* connected to the operation check valve 60*b* and the operation check valve 60*a*; the flow passage 73 through which the first port 71*a* is communicated with the second port 72*a*; the valve seat 72*f* provided in the flow passage 73; the valve body 74 provided in the flow passage 73, the valve body 74 being configured to be separated from and seated on the valve seat 72*f*; the spring 75 configured to bias the valve body 74 in the direction in which the valve body 74 is separated from the valve seat 72*f*; the restriction hole 74*f* formed in the valve body 74, the restriction hole 74*f* being configured to allow communication between the first port 71*a* and the second port 72*a*; the restriction hole 74*g* formed in the valve body 74, the restriction hole 74*g* being configured to allow the communication between the first port 71*a* and the second port 72*a* in a state in which the valve body 74 is separated from the valve seat 72*f*, the restriction hole 74*g* being configured to shut off the communication between the first port 71*a* and the second port 72*a* in a state in which the valve body 74 is seated on the valve seat 72*f*.

With this configuration, the restriction valve 70*b* and the restriction valve 70*a* each has the restriction hole 74*f* and the restriction hole 74*g*. While the restriction hole 74*f* always allows the communication between the first port 71*a* and the second port 72*a*, the restriction hole 74*g* allows the communication between the first port 71*a* and the second port 72*a* in a state in which the valve body 74 is separated from the valve seat 72*f*, and the restriction hole 74*g* shuts off the communication between the first port 71*a* and the second port 72*a* in a state in which the valve body 74 is seated on the valve seat 72*f*. Because each of the opening areas of the restriction valve 70*b* and the restriction valve 70*a* corresponds to a total sum of the opening area of the restriction hole 74*f* and the opening area of the restriction hole 74*g*, the opening areas of the restriction valve 70*b* and the restriction valve 70*a* are changed in accordance with a state of the valve body 74. Because the spring 75 biases the valve body 74 in the direction in which the valve body 74 is separated from the valve seat 72*f*, the valve body 74 is separated from and seated on the valve seat 72*f* in accordance with the flow rate of the working oil directed from the first port 71*a* to the second port 72*a*. Therefore, it is possible to reduce the opening areas of the restriction valve 70*b* and the restriction valve 70*a* in response to the increase in the flow rate of the working oil discharged from the hydraulic cylinder 10 to the main passage 80*b* and the main passage 80*a*.

In this embodiment, the opening area of the restriction hole 74*g* is larger than the opening area of the restriction hole 74*f*.

With this configuration, the opening area of the restriction hole 74*g* is larger than the opening area of the restriction hole 74*f*. The respective differences between: the opening area of the restriction valve 70*b* or the restriction valve 70*a* in a case in which both of the restriction hole 74*g* and the restriction hole 74*f* allow the communication between the first port 71*a* and the second port 72*a*; and the opening area of the restriction valve 70*b* or the restriction valve 70*a* in a case in which only the restriction hole 74*f* allows the communication between the first port 71*a* and the second port 72*a* are large. Therefore, it is possible to reduce the opening areas of the restriction valve 70*b* and the restriction valve 70*a* in response to the increase in the flow rate of the working oil discharged from the hydraulic cylinder 10 to the main passage 80*b* and the main passage 80*a* to a greater extent.

Embodiments of the present invention were described above, but the above embodiments are merely examples of applications of the present invention, and the technical scope of the present invention is not limited to the specific constitutions of the above embodiments.

(1) In the cylinder driving device (100, 200) according to the above-mentioned embodiment, although the working oil is used as working fluid, non-compressive fluid such as water, aqueous liquid, and so forth may be used instead of the working oil.

(2) In the rotating device 1000, the target object W is attached to the end portion 2*a* of the arm member 2. The arm member 2 may be a rotating target object. In addition, instead of the arm member 2, a plate member such as a flat panel may be rotated.

(3) In the cylinder driving device (100, 200) according to the above-mentioned embodiment, as the operation check valve 60*b*, it may be possible to use a switching valve that switches on and off of the flow of the working oil in the main passage 80*b* by a pilot pressure. In this case, the switching valve allows the flow of the working oil in the main passage 80*b* in response to the increase in the pressure in the passage portion 81*b* of the main passage 80*b* or the main passage 80*a* and shuts off the flow of the working oil in the main passage 80*b* in response to the drop in the pressures in both thereof. In the cylinder driving device 100, similarly to the operation check valve 60*b*, it may be possible to use, as the operation check valve 60*a*, a switching valve that switches on and off of the flow of the working oil in the main passage 80*a* by the pilot pressure.

This application claims priority based on Japanese Patent Application No. 2016-130544 filed with the Japan Patent Office on Jun. 30, 2016, the entire contents of which are incorporated into this specification by reference.

The invention claimed is:

1. A cylinder driving device comprising:

an electric motor;

a pump configured to be driven by the electric motor and discharge working fluid;

a first passage and a second passage respectively connected to the pump, the first passage and the second passage being configured to selectively guide the working fluid from the pump;

a fluid pressure cylinder connected to the first passage and the second passage, the fluid pressure cylinder being configured to be operated by the working fluid supplied from one of the first passage and the second passage, the fluid pressure cylinder being configured to discharge the working fluid to the other of the first passage and the second passage when operated;

a control valve provided in the second passage, the control valve being configured to allow a flow of the working fluid directed from the fluid pressure cylinder to the pump in response to an increase in a pressure in the first passage while allowing a flow of the working fluid directed from the pump to the fluid pressure cylinder; and a restriction valve provided between the fluid pressure cylinder and the control valve in the second passage, the restriction valve being configured to restrict a flow of the working fluid directed from the fluid pressure cylinder to the control valve, wherein:

an opening area of the restriction valve is reduced in response to an increase in a flow rate of the working fluid discharged from the fluid pressure cylinder to the second passage; and the restriction valve is set such that the opening area is reduced when a flow rate of the working fluid sucked from the first passage by the fluid pressure cylinder reaches a maximum discharge flow rate of the pump.

2. The cylinder driving device according to claim 1, wherein the restriction valve has:

a first port connected to the fluid pressure cylinder;

a second port connected to the control valve;

a flow passage through which the first port is communicated with the second port;

a valve seat provided in the flow passage;

a valve body provided in the flow passage, the valve body being configured to be separated from and seated on the valve seat;

a biasing member configured to bias the valve body in a direction in which the valve body is separated from the valve seat;

a first restriction portion formed in the valve body, the first restriction portion being configured to allow communication between the first port and the second port; and a second restriction portion formed in the valve body, the second restriction portion being configured to allow the communication between the first port and the second port in a state in which the valve body is separated from the valve seat, the second restriction portion being configured to shut off the communication between the first port and the second port in a state in which the valve body is seated on the valve seat.

3. The cylinder driving device according to claim 2, wherein an opening area of the second restriction portion is larger than an opening area of the first restriction portion.

4. A cylinder driving device comprising:

an electric motor;

a pump configured to be driven by the electric motor and discharge working fluid;

a first passage and a second passage respectively connected to the pump, the first passage and the second passage being configured to selectively guide the working fluid from the pump;

a fluid pressure cylinder connected to the first passage and the second passage, the fluid pressure cylinder being configured to be operated by the working fluid supplied from one of the first passage and the second passage, the fluid pressure cylinder being configured to discharge the working fluid to the other of the first passage and the second passage when operated;

a tank connected to the pump, the tank being configured to compensate a volume change caused by operation of the hydraulic cylinder;

a control valve provided in the second passage, the control valve being configured to allow a flow of the working fluid directed from the fluid pressure cylinder to the pump in response to an increase in a pressure in the first passage while allowing a flow of the working fluid directed from the pump to the fluid pressure cylinder; and a restriction valve provided between the fluid pressure cylinder and the control valve in the second passage, the restriction valve being configured to restrict a flow of the working fluid directed from the fluid pressure cylinder to the control valve, wherein:

the fluid pressure cylinder, the pump, the electric motor, the tank, the first passage, the second passage, the control valve and the restriction valve together form one unit;

the fluid pressure cylinder includes:

a cylinder;

a piston rod extending out from the cylinder, the piston rod being configured to advance and retract with respect to the cylinder; and a piston connected to the piston rod, the piston being configured to partition an interior of the cylinder into a counter rod side chamber and a rod side chamber;

the first passage is connected to the counter rod side chamber;

the second passage is connected to the rod side chamber;

a flow rate of the working fluid flowing between the rod side chamber and the second passage is less than a flow rate of the working fluid flowing between the counter rod side chamber and the first passage, when the hydraulic cylinder is operated;

the control valve and the restriction valve are each provided between the rod side chamber and the pump in the second passage; and an opening area of the restriction valve is reduced in response to an increase in a flow rate of the working fluid discharged from the rod side chamber of the fluid pressure cylinder to the second passage.

5. The cylinder driving device according to claim 4, wherein the restriction valve is set such that the opening area is reduced when a flow rate of the working fluid sucked from the first passage to the counter rod side chamber by the fluid pressure cylinder reaches a maximum discharge flow rate of the pump.

6. The cylinder driving device according to claim 4, wherein the restriction valve has:

a first port connected to the rod side chamber of the fluid pressure cylinder;

a second port connected to the control valve;

a flow passage through which the first port is communicated with the second port;

a valve seat provided in the flow passage;

a valve body provided in the flow passage, the valve body being configured to be separated from and seated on the valve seat;

a biasing member configured to bias the valve body in a direction in which the valve body is separated from the valve seat;

a first restriction portion formed in the valve body, the first restriction portion being configured to allow communication between the first port and the second port; and a second restriction portion formed in the valve body, the second restriction portion being configured to allow the communication between the first port and the second port in a state in which the valve body is separated from the valve seat, the second restriction portion being configured to shut off the communication between the first port and the second port in a state in which the valve body is seated on the valve seat.

7. The cylinder driving device according to claim 6, wherein an opening area of the second restriction portion is larger than an opening area of the first restriction portion.

* * * * *